US010376902B2

(12) United States Patent
Fuller et al.

(10) Patent No.: US 10,376,902 B2
(45) Date of Patent: Aug. 13, 2019

(54) VARIABLE WIDTH FAN NOZZLE

(71) Applicant: WET, Sun Valley, CA (US)

(72) Inventors: Mark Fuller, Sun Valley, CA (US); Jim Doyle, Sun Valley, CA (US); Keith Kalis, Sun Valley, CA (US); Amnon Talmor, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 14/211,847

(22) Filed: Mar. 14, 2014

(65) Prior Publication Data

US 2014/0312145 A1 Oct. 23, 2014

Related U.S. Application Data

(60) Provisional application No. 61/800,068, filed on Mar. 15, 2013.

(51) Int. Cl.

| | |
|---|---|
| ***B05B 1/04*** | (2006.01) |
| ***B05B 1/14*** | (2006.01) |
| ***B05B 1/32*** | (2006.01) |
| ***B05B 17/08*** | (2006.01) |

(52) U.S. Cl.

CPC ..... *B05B 1/14* (2013.01); *B05B 1/044* (2013.01); *B05B 1/326* (2013.01); *B05B 17/08* (2013.01)

(58) Field of Classification Search

CPC .. B05B 1/02; B05B 1/04; B05B 1/042; B05B 1/044; B05B 1/046; B05B 1/32; B05B 1/326

USPC ..... 239/451, 455–460, 537, 538, 540

See application file for complete search history.

(56) References Cited

U.S. PATENT DOCUMENTS

| | | | | |
|---|---|---|---|---|
| 2,366,264 A * | 1/1945 | James | ..... | B05B 1/12 239/455 |
| 3,910,501 A * | 10/1975 | Tyrone | ..... | B05B 7/08 239/417.5 |
| 7,621,467 B1 * | 11/2009 | Garcia | ..... | B05B 1/267 239/200 |

* cited by examiner

*Primary Examiner* — Christopher S Kim
(74) *Attorney, Agent, or Firm* — Maceiko IP

(57) ABSTRACT

A water delivery device that may be used in a water display is described. The device includes an orifice or outlet through which water is shot out. The shape and configuration of the water device may be varied to dynamically adjust the configuration of the water shot out from the device. For example, the water delivery device may shoot out water in the shape of a fan, and the width of the fan may be varied.

15 Claims, 27 Drawing Sheets

VARIABLE WIDTH FAN NOZZLE

CROSS REFERENCE TO RELATED APPLICATION

The application claims the benefit of U.S. Provisional Application No. 61/800,068, filed Mar. 15, 2013, the contents of which are incorporated herein by reference.

FIELD OF THE INVENTION

The present invention generally relates to water displays and devices to deliver water for such displays. This may include water delivery devices that include nozzles which may shoot water out in various configurations, such as a fan-like sheet having a width that may be varied.

BACKGROUND OF THE INVENTION

Various types of water displays exist, and many include a number of devices that shoot water into the air. These devices sometimes include nozzles that shoot water out in different configurations to provide different visual effects. For example, existing water delivery devices may shoot a column of water out of a round pipe. Alternatively, a nozzle may be fitted to the water shooter that has an outlet or orifice through which water is shot. The nozzle outlet may have a particular shape so that the water shot out of the nozzle assumes the configuration of that shape. And besides the shape of the water outlet, the nozzle may have an internal configuration so that water delivered through the outlet provides the desired visual effect.

However, the configuration of current nozzles is typically fixed so that only one configuration of water may be shot out of the water delivery device. For example, existing nozzle outlets typically have a fixed configuration. This may limit the visual effects provided by the water shooter and the overall water display. And if a different visual effect is desired, the nozzle must typically be replaced. This may require significant time and cannot typically be done during a performance by the overall water display.

Accordingly, there is a need for a water delivery device for water displays that may vary the configuration of water shot out of the device without having to change nozzles. There is also a need for such a device that may factor in the interplay between the volumetric flow of water through the nozzle and the nozzle position to provide different visual effects.

SUMMARY OF THE INVENTION

In an aspect of the invention, a water delivery device that delivers water in various configurations is described. For example, the water delivery device may include a nozzle having an internal configuration and/or a water outlet or orifice that may be adjusted to vary the configuration of the water being shot out of the water delivery device. This preferably allows an overall water display to provide more degrees of freedom to provide different visual effects.

In another aspect of the invention, the nozzle may shoot out a stream of water in the shape of a fan. To this end, the nozzle may include an internal chamber that communicates with the nozzle outlet or orifice which may form a rectangle and which produces a fan-shaped stream. Furthermore, the internal chamber and/or the width of the rectangular orifice may be varied so that the fan may be widened or narrowed. Multiple fan widths may be achieved. The internal chamber of the nozzle and/or the outlet or orifice may also be formed in other shapes to provide different types of water streams.

In another aspect of the invention, the rate at which the orifice of the nozzle is opened or closed may also result in different types of water configurations. For example, if the nozzle outlet or orifice is opened and closed slowly, the width of the fan may gradually increase and decrease. If opening and closing of the orifice is sped up, a single stream of water that simultaneously includes wide fan portions and narrow fan portions may result. Alternatively, if the nozzle orifice is opened or closed even more quickly, separate bursts of water may be shot out of the water delivery device.

In another aspect of the invention, the interplay between the volumetric flow of water exiting the nozzle and the rate at which the nozzle is opened or closed may provide different visual effects. For example, holding the volumetric flow constant while increasing the nozzle width may widen the fan and shorten the height of the fan. As an alternative, increasing volumetric flow while the nozzle is opened may serve to maintain the height of the fan while increasing its width.

In another aspect of the invention, the nozzle may reside on a gimbal or other type of housing that allows the nozzle to move about one or more axes. This provides further degrees of variability in the configuration of the water shot out of the water delivery device. For example, in addition to widening or narrowing a fan of water, the fan may also tilt, rotate or move in some other fashion as the fan is adjusted.

DETAILED DESCRIPTION OF THE PREFERRED EMBODIMENTS

Figure 1A:
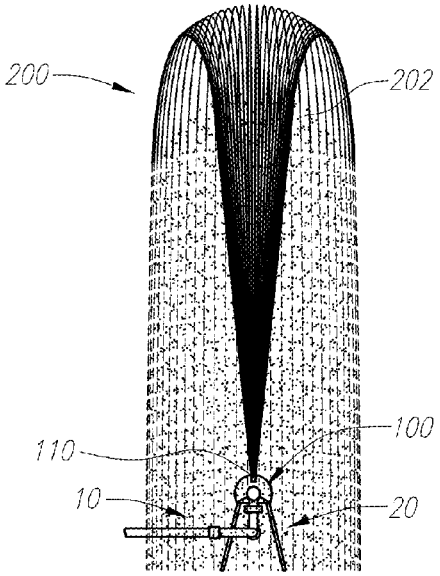
FIGS. 1A-1D are a series of pictures showing how the configuration of a fan of water may be altered by adjusting an outlet orifice of a water delivery device.

The current invention is now described with reference to the figures. Components appearing in more than one figure bear the same reference numerals. The invention is described herein with reference to water. However, the use of other fluids and combinations thereof are within the scope of the invention.

An embodiment of the current invention is now described with reference to FIGS. 1-3, 3A, 3B, 4-8, 9A, 9B and 10-16. As shown in FIGS. 1 and 2, water delivery device 10 may include a variable width fan nozzle 100 that may produce a fan stream of water 200. To this end, device 10 may include a water shooter 20 which may deliver a volume of water to nozzle 100 or other type of water delivery device under significant pressure. An example of such a water shooter 20 that may be fitted with the nozzle 100 of the current invention is disclosed in U.S. Provisional Patent Application Ser. No. 61/739,667, filed Dec. 19, 2012, the contents of which are incorporated by reference as if fully set forth herein. Other types of devices may be used to deliver water to nozzle 100, such as those described in: *Making Water Dance*, Jan. 9, 2003, Machine Design.com. The article may be found at: http://machinedesign.com/article/making-water-dance-0109, and its contents are expressly incorporated by reference as if fully set forth herein. Nozzle 100 may generally provide variable streams of water by varying the size or shape of water outlet or orifice 110 of nozzle 100. For example, nozzle 100 of the current invention may provide the water display effects shown in FIGS. 1A-1D. These effects represent an advance over existing water delivery devices because they may be provided by a single nozzle. That is, while different existing water delivery devices may deliver differently configured water streams, each device is generally limited to a particular configuration. This is because the nozzle in each such water delivery device is machined or otherwise fabricated to provide only one configuration, and is not fabricated so that its orifice may be varied.

For example, existing nozzles may be made of metal or plastic and as such provide a fixed shape to its exit outlet. And where the shape of the water stream is a fan, while the shape and visual nature of the extruded water fan may vary in character from nozzle to nozzle, such as from clear and glassy to striated, as well as in dimension (30 degrees of a circle, 60 degrees, etc.), as noted above, the visual effect is still dictated and thus restricted by the single configuration of the nozzle itself, which is typically machined from metal or plastic.

In contrast, the current invention may dynamically alter the internal configuration of the nozzle and/or the dimensions of the exit orifice or outlet so that the thickness and the angular intercept of the fan (or other shape or configuration) can be changed during a water performance. In the ideal condition, the stream may be altered from a circular stream of water, through a narrow fan, up to and including a wide fan as shown in FIGS. 1A-1D. The variability of the nozzle may be controlled manually or under computer control. This control may be synchronized with music, lighting or other media to enhance the overall water display.

Before describing the structure and operation of device 10 and nozzle 100 in detail, reference is first made to FIGS. 1A-1D and FIGS. 5-8. FIGS. 1A-1D comprise a series of pictures showing how nozzle 100 may produce a fan 200 of water having a variable width. FIGS. 5-8 comprise a series of pictures showing how nozzle orifice 110 may be widened to produce the fans shown in FIGS. 1A-1D. To this end, the fan of FIG. 1A may be produced by nozzle 100 when its orifice 110 is adjusted to the position shown in FIG. 5; the fan of FIG. 1B may correspond to the orifice 110 of FIG. 6; the fan of FIG. 1C may correspond to the orifice 110 of FIG. 7 and the fan of FIG. 1D may correspond to the orifice 110 of FIG. 8. As shown, in this embodiment of the current invention, the fan 200 remains as a contiguous sheet of water having a varying width and/or height.

Figure 5:
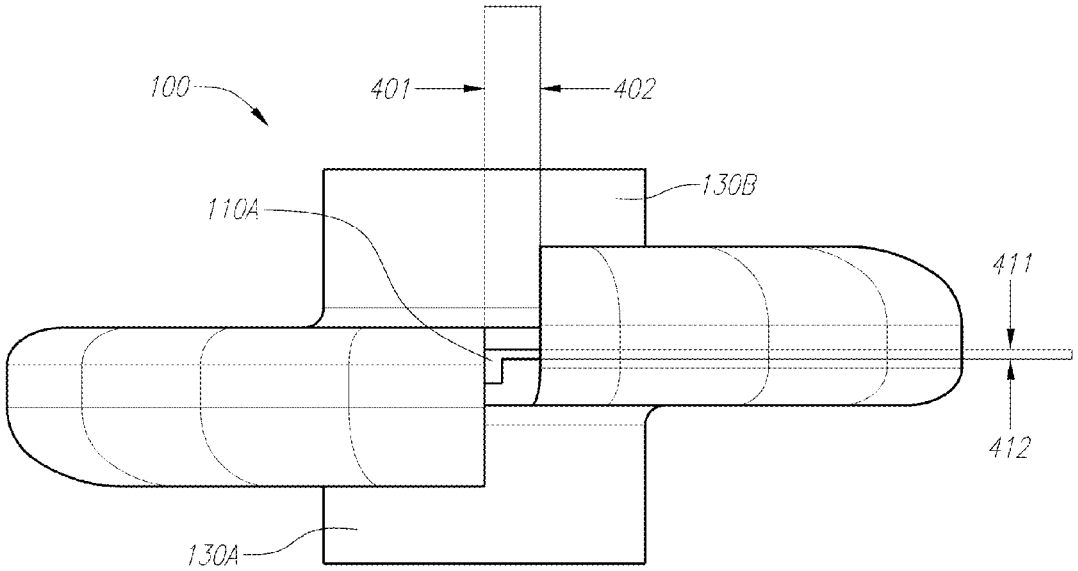
FIG. 5 is a top view of a variable width fan nozzle.

The relatively narrow fan pattern 202 depicted in FIG. 1A, may be produced when orifice 110A, whose open dimension may be defined as the distance between orifice end 401 and orifice end 402, as well as the distance between orifice top 411 and orifice bottom 412, as shown in FIG. 5, which is relatively small and/or in an almost closed position. When so configured, nozzle 100 may restrict the dispersion of water being pumped through nozzle 100 to the narrow fan pattern shown in FIG. 1A.

Figure 1B:
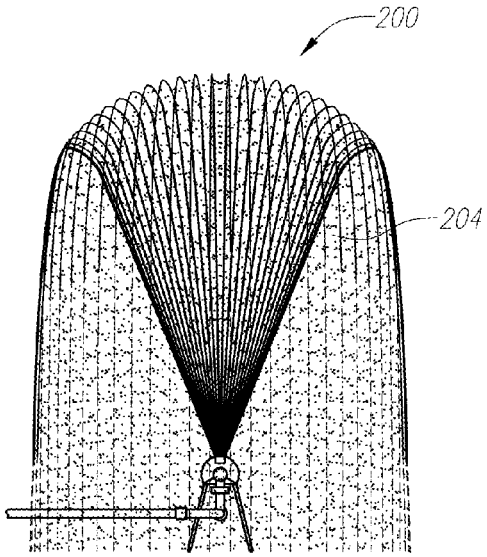
Figure 6:
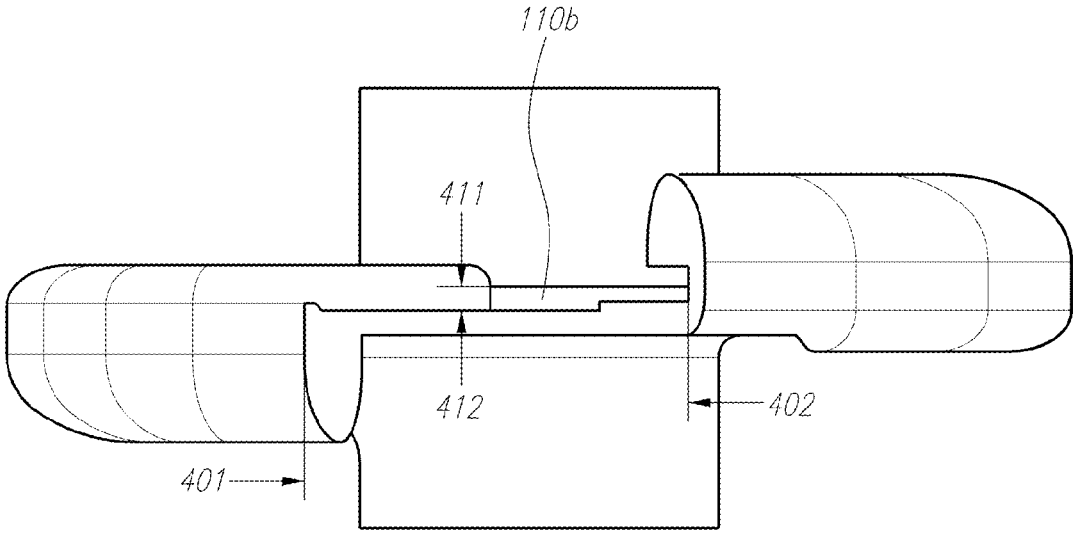
FIG. 6 is a top view of a variable width fan nozzle where the width of the water outlet has been increased.

The wider fan pattern 204 depicted in FIG. 1B may be produced when orifice 110B, whose open dimension may be defined as the larger distance between orifice ends 401, 402, is opened up a bit as shown in FIG. 6. The orifice top and bottom 411, 412 may remain the substantially the same. As can be seen, orifice 110B is wider than orifice 110A shown in FIG. 5, and the width of the fan 204 shown in FIG. 1B is wider than shown fan 202 in FIG. 1A. This allows more lateral dispersion of water being pumped through nozzle 100, hence a wider fan pattern.

Figure 1C:
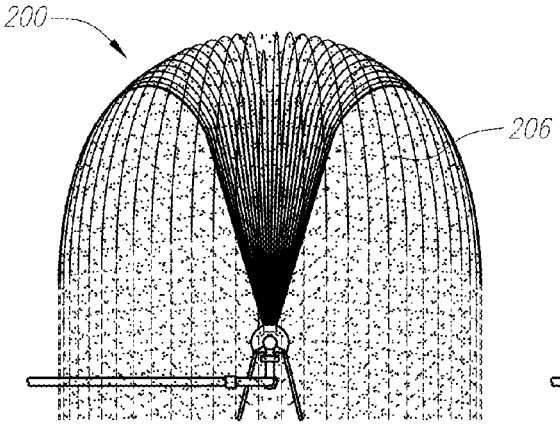
Figure 7:
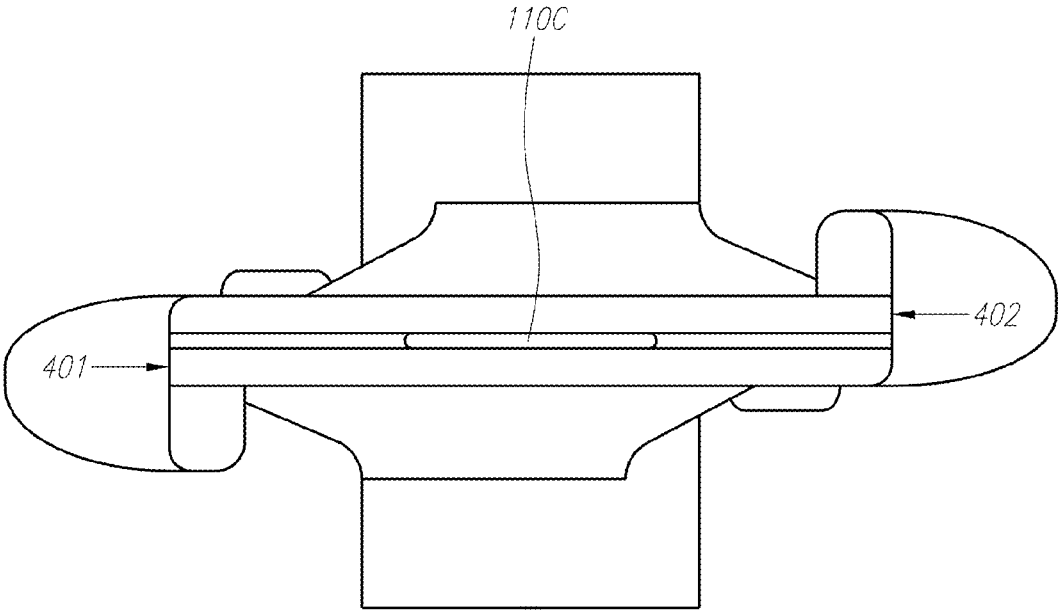
FIG. 7 is a top view of a variable width fan nozzle where the width of the water outlet has been increased.

The still wider fan pattern 206 depicted in FIG. 1C, may be produced when the distance between orifice ends 401, 402 is further increased as depicted in FIG. 7. This wider orifice 110C thereby allows even more lateral dispersion of water being pumped through nozzle 100, hence an even wider fan pattern.

Figure 1D:
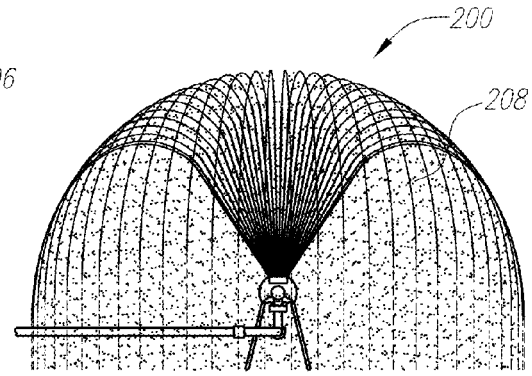
Figure 8:
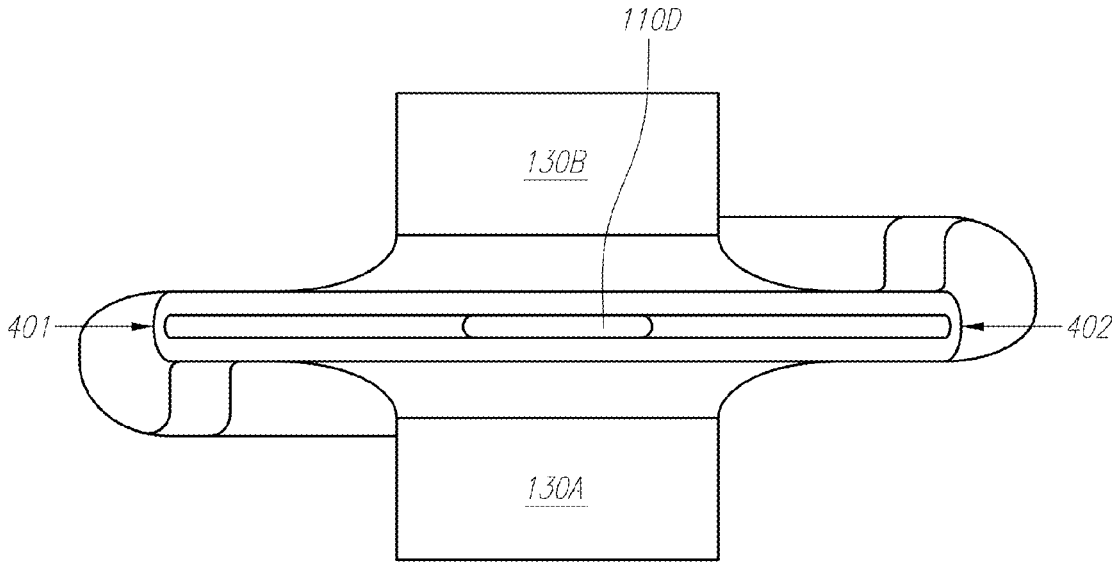
FIG. 8 is a top view of a variable width fan nozzle where the width of the water outlet has been increased.

The widest fan pattern 208 depicted in FIG. 1D, may be produced when orifice ends 401, 402 are opened to their widest setting as shown in FIG. 8. This widest orifice 110D may allow the widest possible lateral dispersion of water being pumped through nozzle 100, hence the widest fan pattern.

The manner in which orifice 110 may be opened and closed is further described later on. As also discussed later on, the current invention involves the interplay between the volumetric flow of water through nozzle 100 and the speed at which nozzle 100 is opened or closed. In the example of FIGS. 1A-1D, volumetric flow is held generally constant, so the fan height decreases as its width increases. Also, nozzle 100 is opened relatively slowly in FIGS. 1A-1D thereby providing a contiguous and gradually widening fan.

Another configuration of a fan pattern that may be produced by nozzle 100 of the current invention is now described with reference to FIGS. 2A-2D. In this embodiment, nozzle 100 may produce a fan 300 which comprises separate bursts of water and/or bursts of water that may be contiguous by a thin water stream. As described further below, the separate water bursts may occur due to a rapid opening and closing of nozzle 100.

Figure 2B:
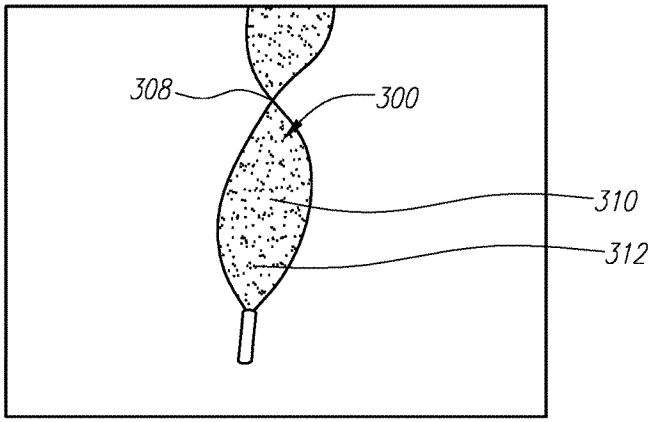
FIGS. 2A-2D are a series of pictures showing how the configuration of a fan of water may be altered by adjusting an outlet orifice of a water delivery device.
Figure 2D:
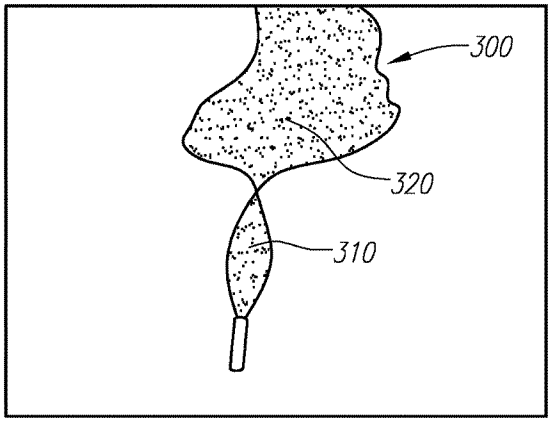
Figure 2A:
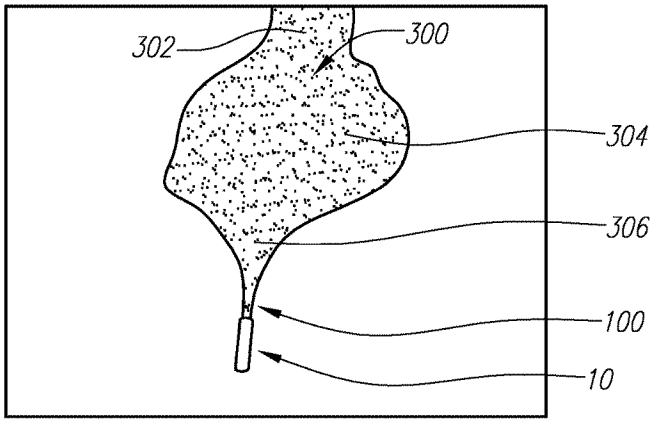

FIG. 2A shows a first water stream pattern 300 that may include a narrow top portion 302, followed by a wider middle portion 304, followed by another narrower portion 306. This fan configuration 300 may be produced by first pumping water from device 10, through nozzle orifice 110 at a relatively closed position, then increasing the width of nozzle orifice 110 to a wider position, and then closing orifice 110 again to be a relatively closed position. The opening and closing of nozzle 100 may occur relatively quickly to produce the fan pattern shown in FIG. 1A.

As shown in FIG. 2B, nozzle 100 may produce a different water stream pattern 300. Here, fan 300 may start with maintaining the stream through nozzle orifice 110 at a narrow position so as to produce thin portion 308. Nozzle 100 may then be opened again so that wider portion 310 forms. However, for the fan 300 of FIG. 2B, nozzle 100 is not opened as wide as in FIG. 2A which is evidenced by wide portion 310 being narrower than wide portion 304 in FIG. 2A. Nozzle 100 may then be closed to produce narrow portion 312. Assuming the fan patterns 300 of FIGS. 2A and 2B are formed during over intervals of about the same time, it can be appreciated that nozzle 100 in FIG. 2B is opened and closed more slowly since its widest portion 310 is narrower than wide portion 304 in FIG. 2A. This exemplifies the interplay between volumetric flow and the rate at which nozzle 100 is opened and closed. Here flow may remain constant but nozzle adjustment may be slowed.

Figure 2C:
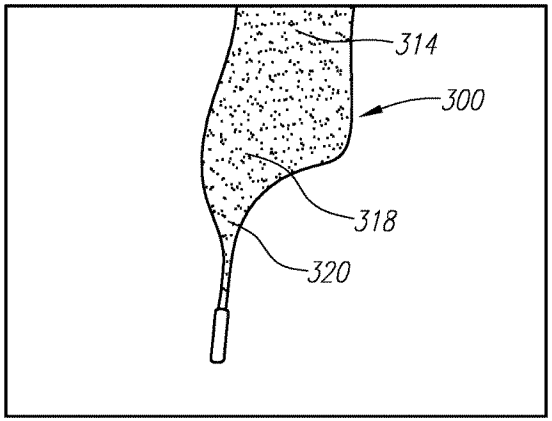

As shown in FIG. 2C, fan 300 may comprise a narrow portion 319, wider portion 318 and narrower portion 320. This represents a relatively quick opening and closing of nozzle 100.

FIG. 2D shows how two fan patterns 300 may be produced by opening nozzle 100 relatively wide and quickly, followed by a quick closing, followed by a slower opening of nozzle 100 to not so wide a position. These two water stream patterns produced by one orifice 110, and the relatively quicker timing between the productions of these two water stream patterns, illustrates the variable orifice and time interval settings made possible by this invention.

Figure 3:
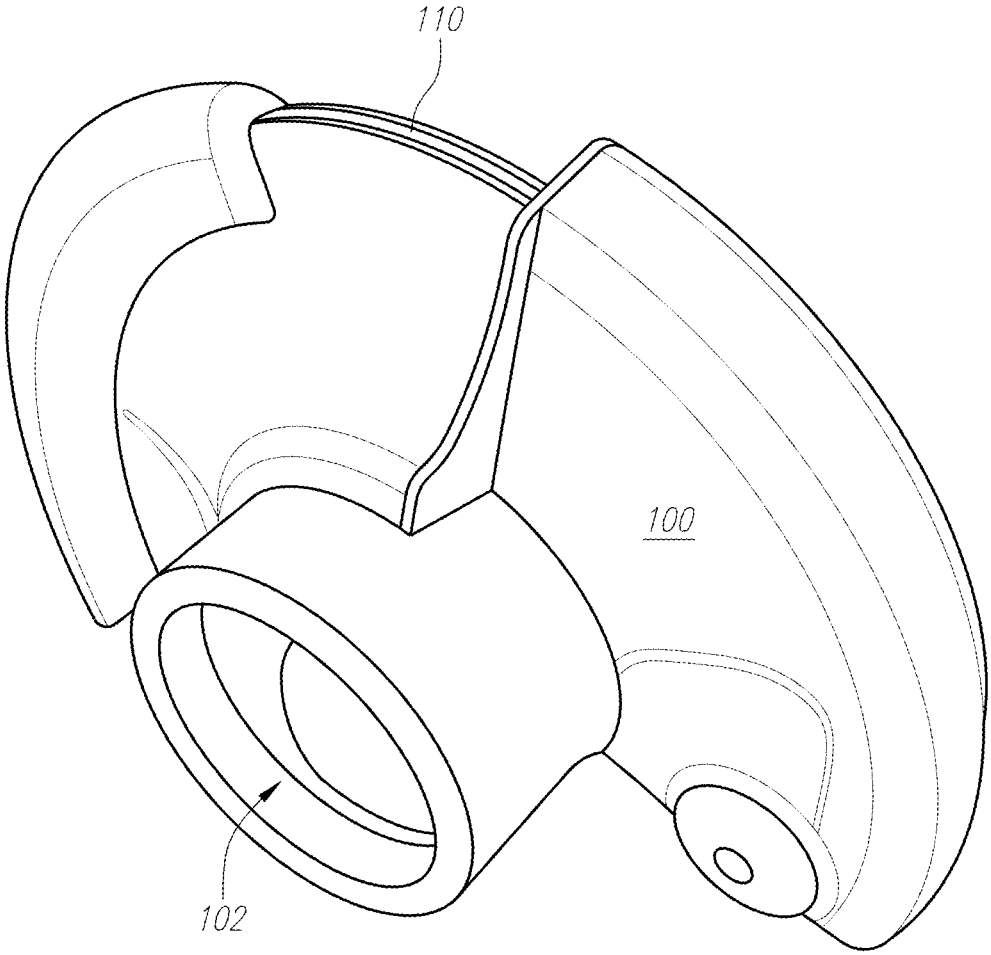
FIG. 3 is a perspective view of a variable width fan nozzle.
Figure 9A:
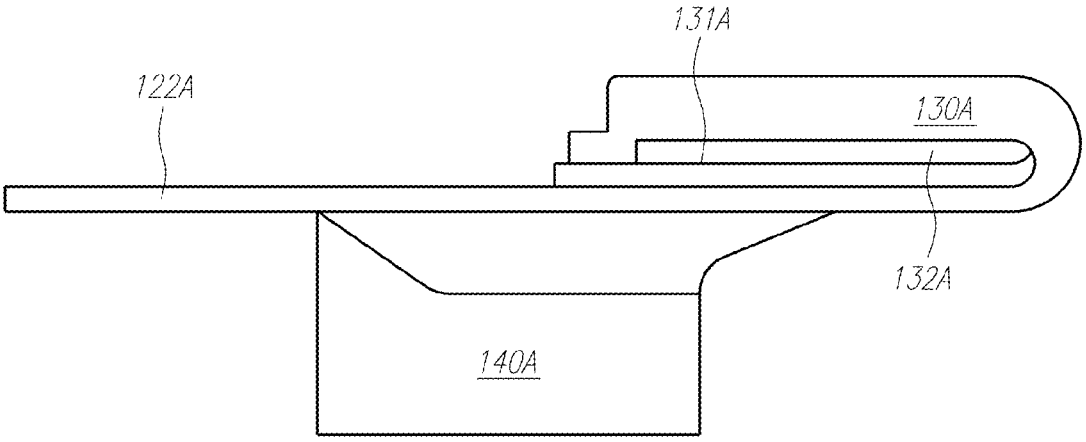
FIGS. 9A and 9B are top views of respective halves of a variable fan width nozzle.
Figure 9B:
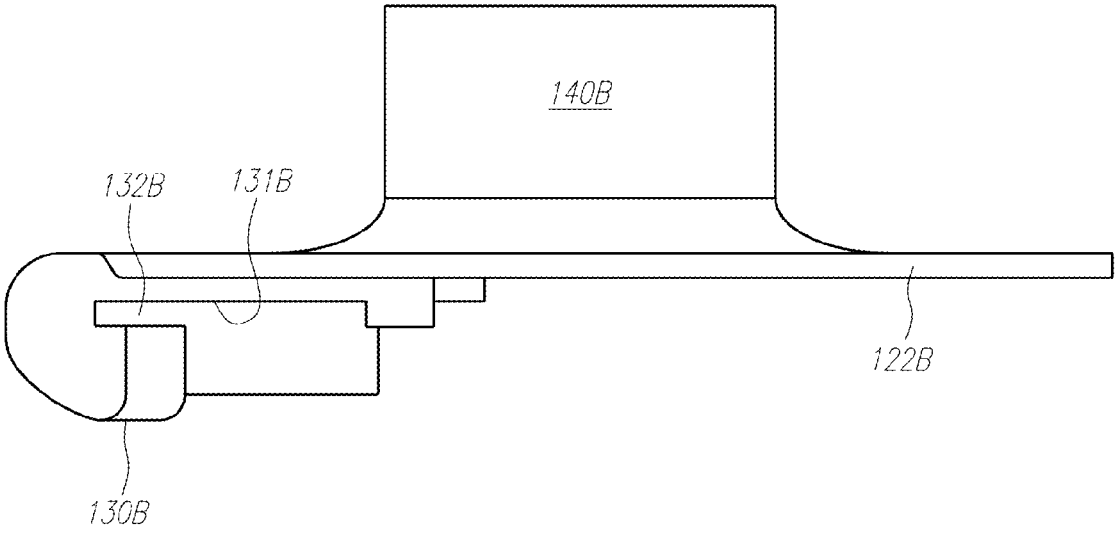
Figure 10:
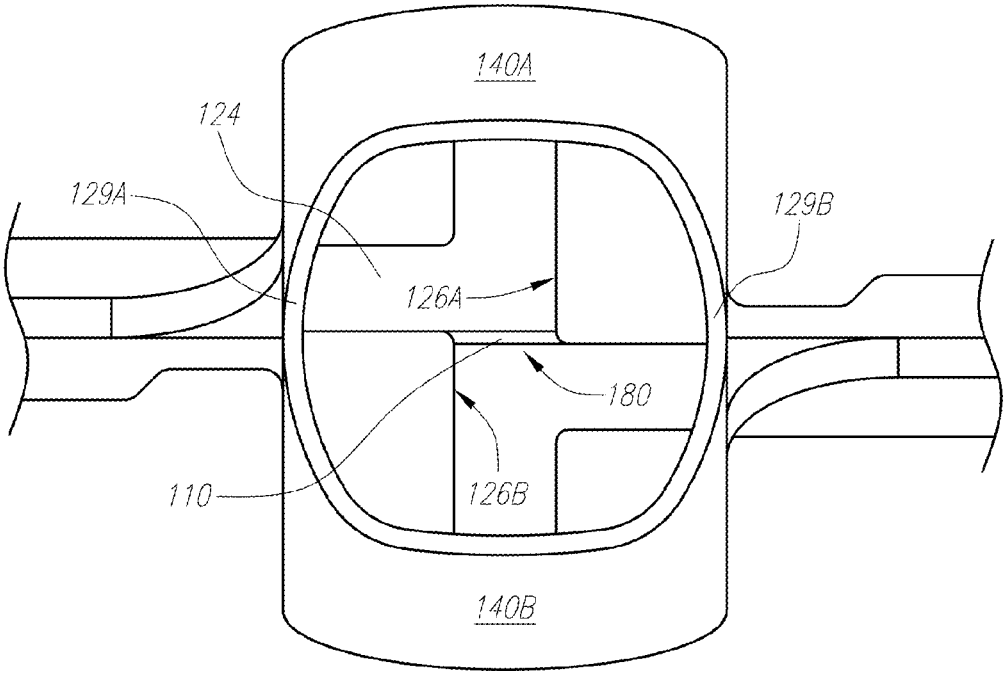
FIG. 10 is a view from the bottom of an assembled nozzle showing a chamber to receive water.

An embodiment of nozzle 100 is now described in more detail with reference to FIGS. 3, 4, 9A, 9B and 10-16. In this embodiment, nozzle 100 may generally comprise two flanges 120A, 120B. FIGS. 3 and 10 show flanges 120A, 120B assembled together to form nozzle 100 while FIGS. 4, 9A, 9B and 10-14 shows them separated. Water outlet or orifice 110 may be formed when flanges 120A, 120B are assembled together. As shown, orifice 110 may comprise a rectangle. In this embodiment, the rectangle may be curved in convex manner thereby reflecting the overall curve of flanges 120A, 120B. Generally, the width of this rectangle may be varied to adjust the width of the fan 200, 300 as shown by FIGS. 5-8. As discussed in more detail below, this may occur by rotating flanges 120A, 120B relative to each other.

In a preferred embodiment, flanges 120A, 120B may be identical or substantially similar so that when one of the flanges is flipped around and oriented opposite to the other flange, the pair may be assembled as shown in FIG. 3 to form nozzle 100. The identical or similar nature of flanges 120A, 120B may be preferable because it may decrease manufacturing costs by reducing the number of different parts that may need to be produced to form nozzle 100.

As an alternative, flanges 120A, 120B need not be identical. Instead, nozzle 100 may comprise two flanges or other components that may be assembled to provide a water outlet that may be varied. In any event, the scope of the current invention includes various types of nozzles that may provide a water outlet or orifice that may be varied to provide different configurations of water streams.

Figure 4:
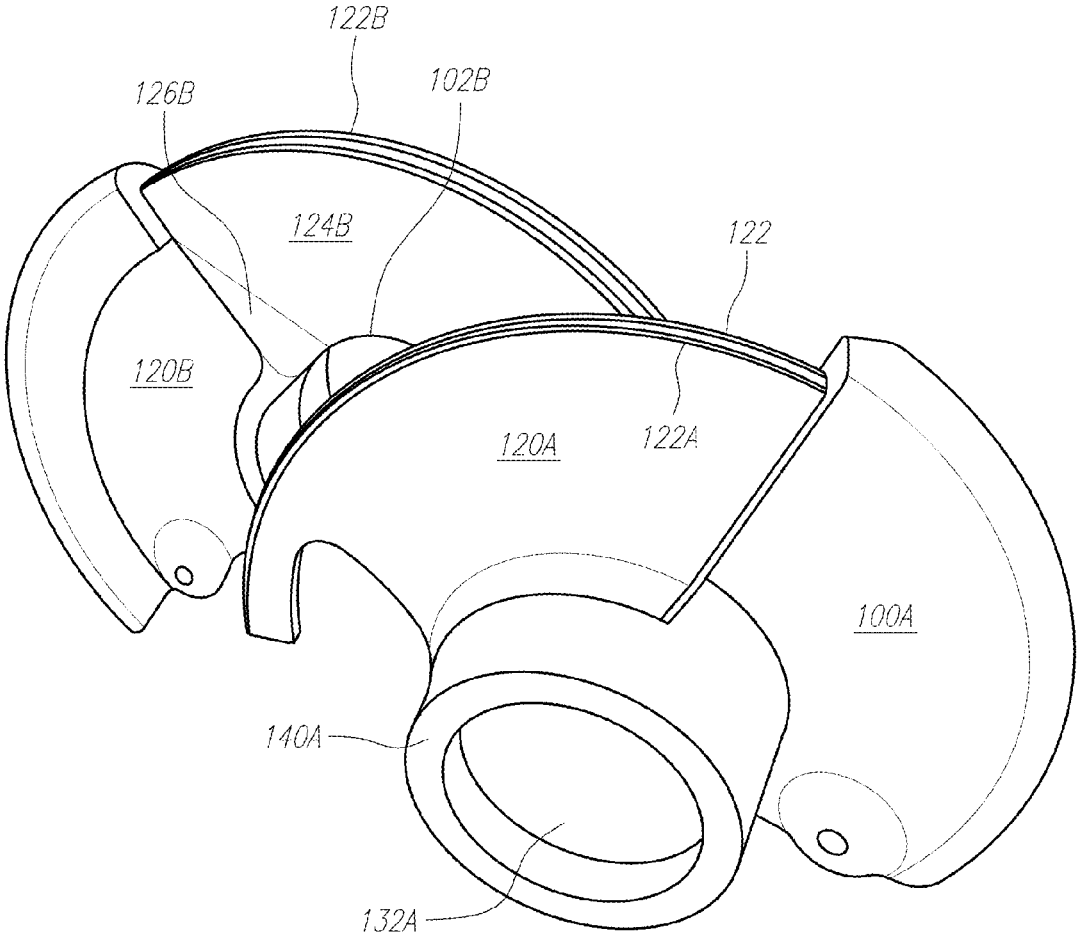
FIG. 4 is a perspective view of a variable width fan nozzle in a disassembled state.
Figure 11:
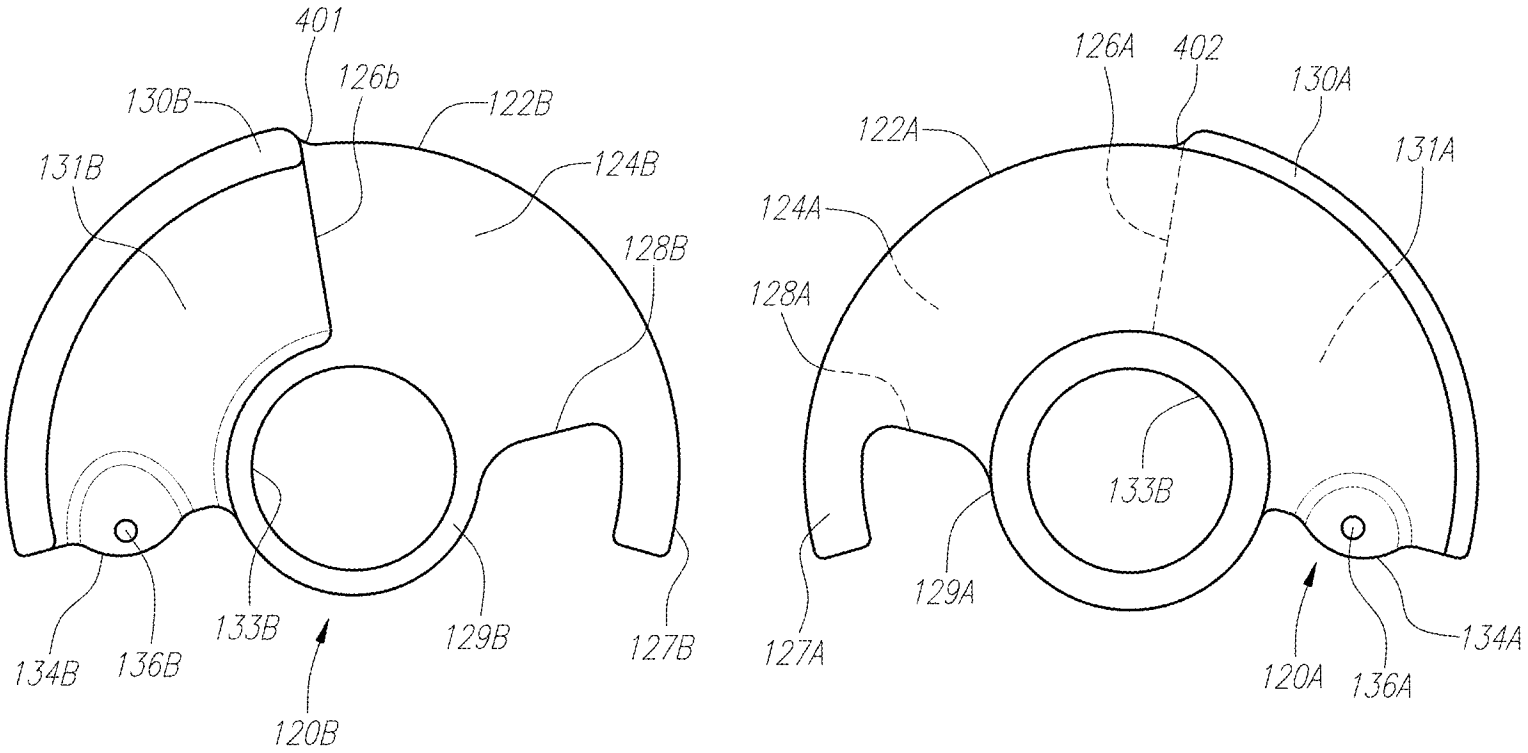
FIG. 11 is a side view of nozzle flange components positioned side by side.
Figure 13:
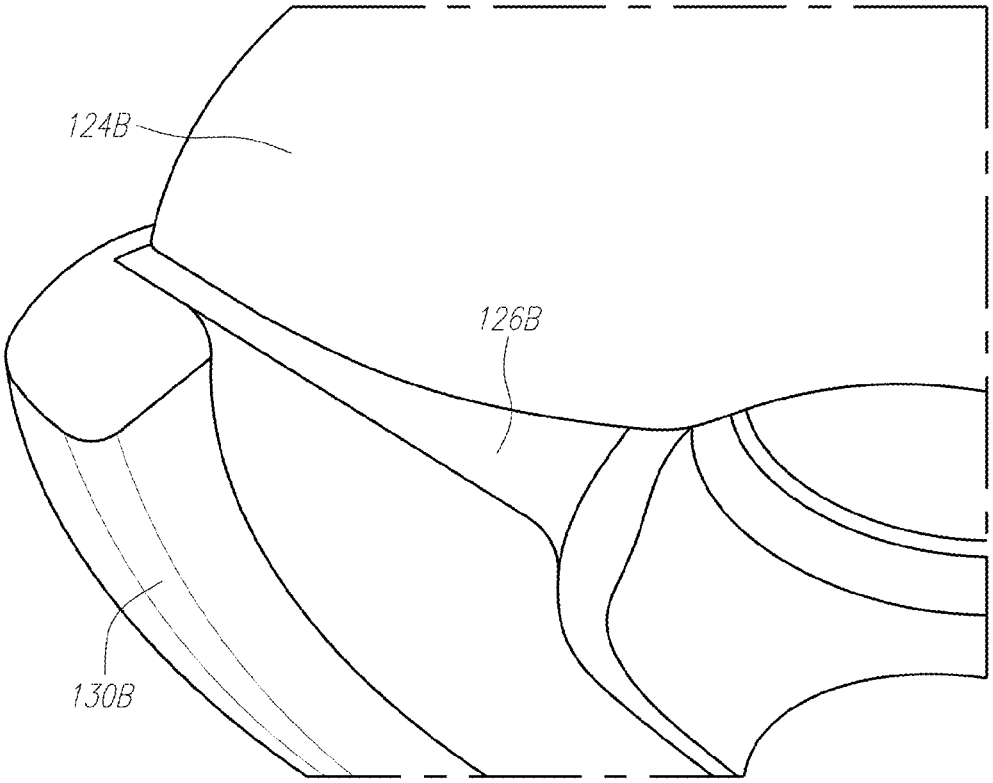
FIG. 13 is a perspective view of a portion of a nozzle flange.
Figure 16:
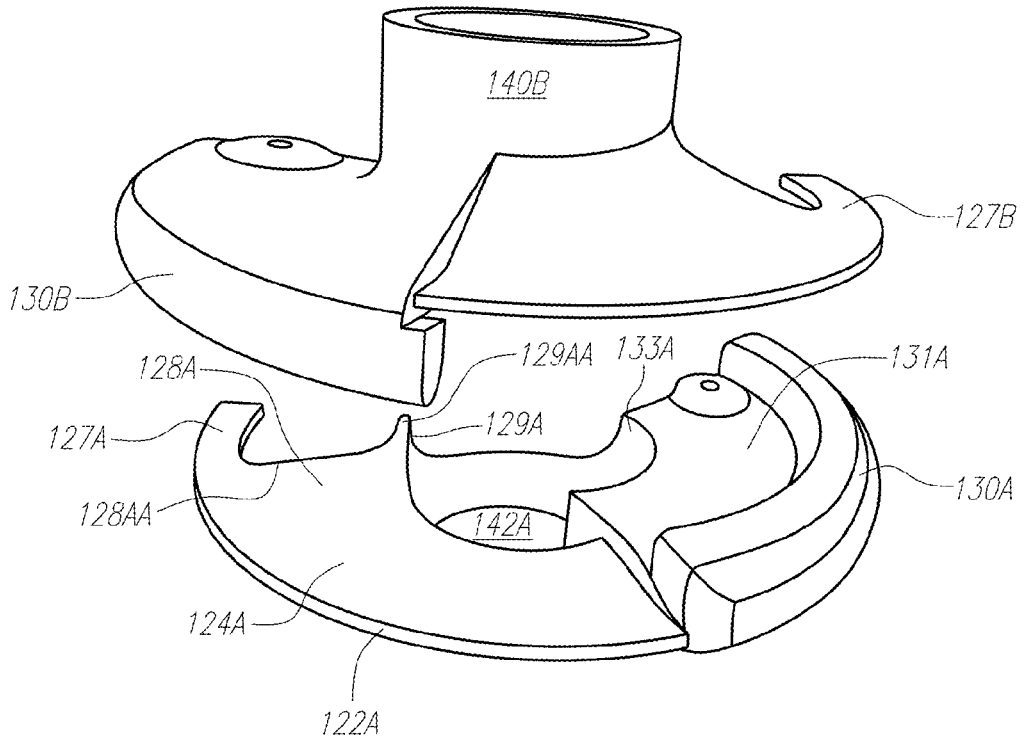
FIG. 16 is a top perspective view of nozzle flanges.

As shown in FIGS. 4, 11 and 16, flanges 120A, 120B may each include chamber disk portions 122A, 122B, which may each have an inner surface 124A, 124B. FIG. 11 shows the two flanges 120A, 120B positioned side by side. Because certain component in flange 120B would actually reside on the opposite side shown, certain leader lines are shown in dashed lines, e.g., inner surface 124A. Inner surfaces 124A, 124B may generally slope towards each other as they near orifice 110. (This is best shown in FIG. 13 by viewing the curved nature of chamber end wall 126B which intersects with inner surface 124B.) The amount of this slope may affect the appearance of the fan stream 200, 300 exiting nozzle 100. Flanges 120A, 120B may also include chamber end walls 126A, 126B and chamber end walls 128A, 128B. Chamber end walls 128A, 128B may continue to respective end walls 129A, 129B. As discussed in more detail below, a chamber or reservoir 180 may be formed by inner surfaces 124A, 124B, chamber end walls 126A, 126B and chamber end walls 128A, 128B. Water from a water supply (not shown) may be supplied to chamber 180 en route to the water being propelled out of orifice 110 and into the air as a water stream pattern such as fan 200, 300.

Flanges 120A, 120B may each also include an arm 127A, 127B that may extend from chamber disk portions 122A, 122B.

Flanges 120A, 120B may each also include caps or closure portions 130A, 130B. Caps 130A, 130B may generally be contiguous with chamber disk portions 122A, 122B and may be located outside the chamber end walls 126A, 126B. As best shown in FIGS. 9A and 9B, caps 130A, 130B may comprise a thickness of material that extends toward the other flange when nozzle 100 is assembled. As also shown in FIGS. 9A and 9B, caps 130A, 130B may also include slots 132A, 132B. Flanges 120A, 120B may also include interior cap portion surfaces 131A, 131B which may extend from the mounting portion 140A, 140B (which is discussed below) to the periphery of slots 132A, 132B. Interior cap portion surfaces 131A, 131B may include stops 134A, 134B, which may themselves include a hole 136A, 136B.

Figure 14:
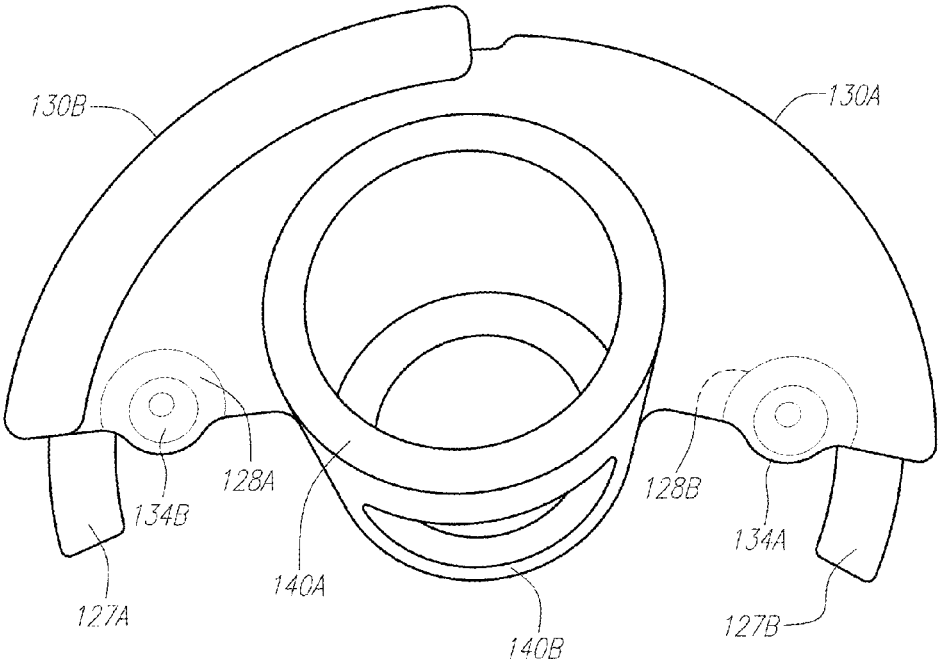
FIG. 14 is a perspective view of a nozzle.

When flanges 120A, 120B are assembled to form nozzle 100, arm 127A may fit into slot 127B, and arm 127B may fit into slot 132A. And when flanges 120A, 120B are rotated relative to each other, arms 127 may slide along their respective slots 132. As shown in FIG. 14, as nozzle 100 is closed, arms 127 may extend along enough into slots 132 so that the ends of arm 127 protrude beyond the end of slots 132. At this point, wall 128A may engage stop 134B and wall 128B may engage stop 134A. This may serve as a position to define the most closed configuration of orifice 110 and the narrowest fan beam 200, 300 that may be produced.

This engagement between arms 127 and slots 132 may provide structural integrity that helps flanges 120A, 120B remain together despite the pressure of water flowing through chamber 180 that may exert an outward force that would tend to separate flanges 120A, 120B. The engagement between arms 127A, 127B and slots 132A, 132B may be sufficiently tight so as to prevent water leakage as well as support the desired setting of the orifice 110. However, this engagement is preferably not too tight that there is difficulty in rotating flanges 120A, 120B relative to each other.

Flanges 120A, 120B may also include a mounting portion 140A, 140B as shown in FIGS. 3, 4, 9A, 9B, 10, 14 and 16. In a preferred embodiment, nozzle 100 may be mounted onto a pipe (not shown) that may also serve as a water source. To facilitate this arrangement, mounting portions 140A, 140B may be cylindrical as shown in the above-referenced figures. When configured in this manner, cylindrical portions 140A, 140B may include hole 142A, 142B through which the water supply pipe may pass. The supply pipe may provide water through a hole or holes in the pipe wall which leads to chamber 180 of nozzle 100. The water may then be propelled through orifice 110 and into the air in the desired visual configuration.

The manner in which chamber 180 may communicate with orifice 110 is now further described with emphasis on FIGS. 10 and 11. Generally, the width of the top of chamber 180 may generally coincide with the ends 401, 402 of orifice 110. This may occur in that chamber walls 126A, 126B may coincide with orifice ends 401, 402. And when orifice 110 is in its widest open position, chamber wall 128A may coincide with chamber wall 126B, and chamber wall 128B may coincide with chamber wall 126A. As orifice 110 is moved between its most closed and most open positions, the walls of chamber 180 may continue to define chamber 180 so that the top of chamber 180 generally has the same width as orifice 110 at any given time.

Figure 15A:
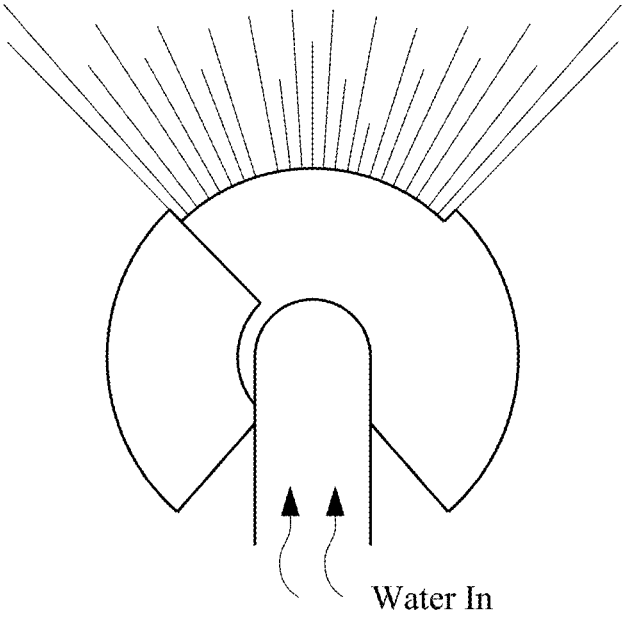
FIGS. 15A and 15B are side views of a nozzle in open and closed positions, respectively.
Figure 15B:
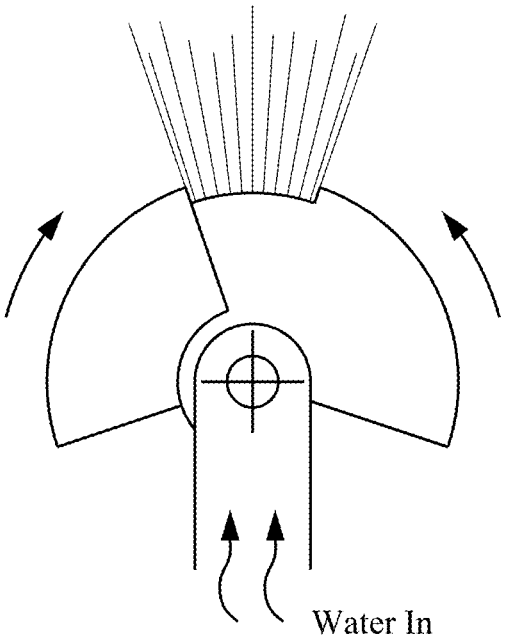

The manner in which nozzle 100 may be adjusted to provide different configuration water features 200, 300 is now further described with reference to FIGS. 14, 15A and 15B. As mentioned above, once flanges 120A, 120B are assembled, they may be rotated relative to each other. This is shown in FIGS. 15A and 15B, where FIG. 15A shows flanges 120A, 120B rotated to a more open position to provide a wider fan, while FIG. 15B shows flanges 120A, 120B rotated to a more closed position to provide a narrow fan.

Figure 12:
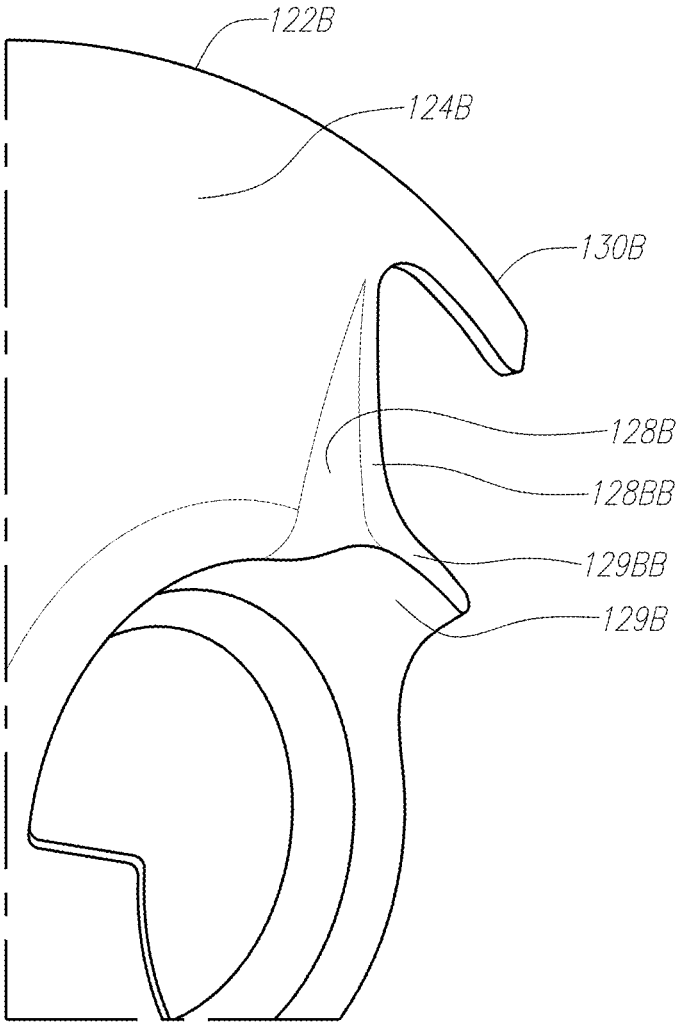
FIG. 12 is a perspective view of a nozzle flange.

During rotation of flanges 120A, 120B, the various surfaces described above may act as bearing surfaces upon which the flanges may rotate relative to each other while still keeping chamber 180 relatively sealed and maintaining water pressure so that water may be forcefully propelled through orifice 110. That is, as shown in FIG. 16, as flanges 120A, 120B are rotated relative to each other, the top ridge 128AA of chamber end wall 128A and the top ridge 129AA of end wall 129A may be in contact with and glide across the interior cap portion surface 131B. Similarly, as shown in FIG. 12, the top ridge 128BB of chamber end wall 128B and the top ridge 129BB of end wall 129B may be in contact with and glide across the interior cap portion surface 131A. At the same time, the outer edges of arms 127A, 127B may be in contact with and slide within slots 132B, 132A. This engagement may help keep chamber 180 sealed so that water does not leak out.

Flanges 120A, 120B may rotate upon a water supply pipe (not shown) that extends through holes 142A, 142B. To this end, it is preferred that a gasket or relatively tight fit exist between holes 142A, 142B and the water supply pipe so that water does not leak and so that water pressure is not lost. To this end, end walls 129A, 129B may generally be curved so as to engage the curvature of the water supply pipe. Similarly, the interior edges of interior cap surfaces 131A, 131B may conclude with an edge or wall 133A, 133B that is also curved so as to engage the curvature of the water supply pipe. In this manner, a portion of the interior surface of each of flange 120A, 120B may engage the water supply pipe. Similarly the exterior ends of mounting or cylindrical portions 140A, 140B also preferably fit snugly around supply water pipe.

Rotation may be effected by control arms (not shown) fitted into holes 136A, 136B which may raise and lower, thereby directing flanges 120A, 120B up or down with them. Other mean may be used to open and close flanges 120A, 120B relative to each other. It is preferred that the means used to effect rotation may do so at any desired rate so that nozzle 100 may be opened and closed quickly or slowly to allow various water fan displays based on the interplay with volumetric flow.

The different variables and the interplay therebetween that may affect the appearance of water fan stream 200, 300 is now further described. These variables may include orifice opening size, the rate at which orifice 110 is opened and closed, volumetric flow and a movable mount on which nozzle 100 may reside, are all aspects of this invention that allow the user many creative possibilities of water stream patterns or fans 200, heights and frequency of pulses of water.

An example of a combination of two of the variable aspects of the current invention is orifice opening size and volumetric flow and their relationship to water stream height. The height of the water stream pattern may be maintained as the orifice is opened by increasing the volumetric flow of the water being pumped into the nozzle 100. Alternatively, volumetric flow may be kept constant while the orifice opening 110 is increased, thereby lowering the height of the water stream pattern while fan width increases.

Another example of a combination of two of the variable aspects of this invention involves the relationship between the volumetric flow of the water being pumped into nozzle 100 and a gimbal type mounting. As the water pressure varies and the gimbal allows the nozzle to move in a circular fashion, the resulting water stream patterns will vary in distance from the nozzle. The display may be farther enhanced by opening or closing nozzle 100 at the same time.

Another example of a combination of variables involves varying the amount of time that an orifice would remain open, while the water pressure would vary. The resulting water stream shape and the distance that the water stream shape would project away from the nozzle would change as discussed in connection with FIGS. 2A-2D.

Multiple nozzles 100 may be attached in series to a common water supply, pipe, or other water source, in order to permit more options in producing multiple water stream patterns or fans 200 from a common water source.

While orifice 110 length of opening as defined by the distance between orifice end 401 and orifice end 402 is variable, orifice width as defined by the distance between orifice side 411 and orifice side 412, as shown in FIG. 15, may be different from nozzle to nozzle. A difference in width contributes to the range of options one has in determining the water stream shape.

While orifice 110 shape may be rectangular, it may also exhibit different shapes. Different shapes may contribute to different textures in the water stream, contributing to a greater range in options one has in determining the desired water stream shape. For example, the top and bottom edges of orifice 110 may be saw-toothed, elliptical or some other shape. The internal aspects of flanges 120A, 120B may be altered so that chamber 180 properly communicates with these alternate orifices.

The shape and configuration of fan stream 200, 300 may also be varied by varying the distance between top 411 and bottom 412. In this manner, the transverse dimension of the orifice may also be varied in addition to the length of the orifice.

Another embodiment of the current invention is now described with reference to FIGS. 17-26. In this embodiment, water delivery device 500 may generally include metal frame base structure 510 that may support various components. Device 500 may also include supporting manifolds 530A, 530B that receive water from multiple water input tubes 535. Manifolds 530A, 530B may distribute water through flexible tubes 540 to a series of water shooters 570. Each manifold 530A, 530B may distribute water for half of the water shooters 570 of device 10, but other water distribution proportion may also be used.

Water shooters 570 may each receive water from tubes 540 and propel water into the air under significant pressure. As discussed later, water may be delivered from all or some number of water shooters 570 to provide different water stream patterns for different visual effects.

Figure 17:
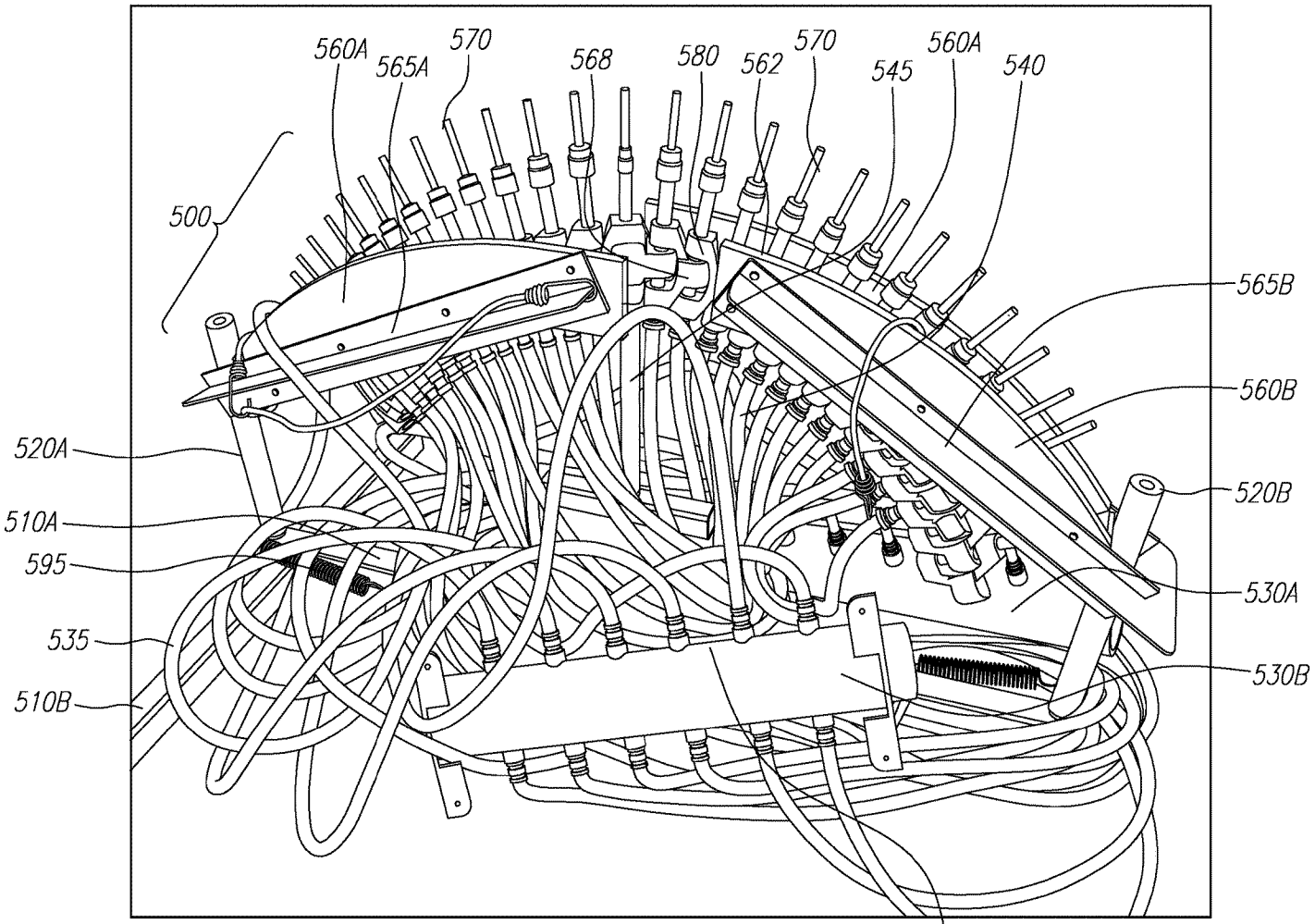
FIG. 17 is a side view of an alternate water delivery device.

As shown in FIG. 17, each manifold 530A, 530B may include manifold valves 550 that may provide control over the flow of water through the water shooters 570 so that the timing and duration of the pulses of water shot therefrom may produce different water stream fans. Manifold valves 550 may also be individually controlled so that, for example, certain water shooters 570 may receive and shoot water, while others do not. This preferably results in different-sized water stream fans and varying water displays.

Water input tubes 535 may receive water from an outside source (not shown) in order to feed water into each the manifolds 530A, 530B. Water input tubes 535 may be constructed of a pliable material so that they may flex to accommodate the different positions that water shooters 570 may assume while device 10 provides a water display.

Metal frame base structure 510 may be fabricated from metal tubing that may have a square, round or other shaped cross-section. Frame 510 preferably provides support for the water delivery device 500 assembly. Frame 510 may also provide mobility to device 500. That is, frame 510 may be configured with wheels or other components to make it transportable.

Base structure 510 may be configured in three pieces as shown in FIG. 17, including a longitudinal central spine tube 510A, with cross tubes 510B and 510C attached at a ninety degree angle at each end of, and bisected by, the spine tube. Other configurations for the framework of base 510 may be used within the scope of the invention. In any event, it is preferred that metal frame base structure 510 is heavy enough in order to stay in place and counteract the resulting forces from shooting water that occur during the operation of water delivery device 10 when projecting water in various water stream fans.

Alternatively, base 510 may be attached to the ground, to the reservoir floor of a water display or other location to provide stability. To this end, metal frame base structure 510 may include holes drilled in the frame metal to accommodate bolts or other attachment means.

Vertical support posts 520A, 520B, shown in FIG. 17, may be securely attached to the center of each end cross tube 510B, 510C, which may be fastened to each end of longitudinal central spine tube 510A. This preferably provides solid mounting points for guide arm supports 565A, 565B. (These components are further discussed below.) Vertical support posts 520A, 520B may also be hollow in order to minimize weight, to benefit portability, yet provide ample sturdy support of the water delivery device apparatus.

Figure 18:
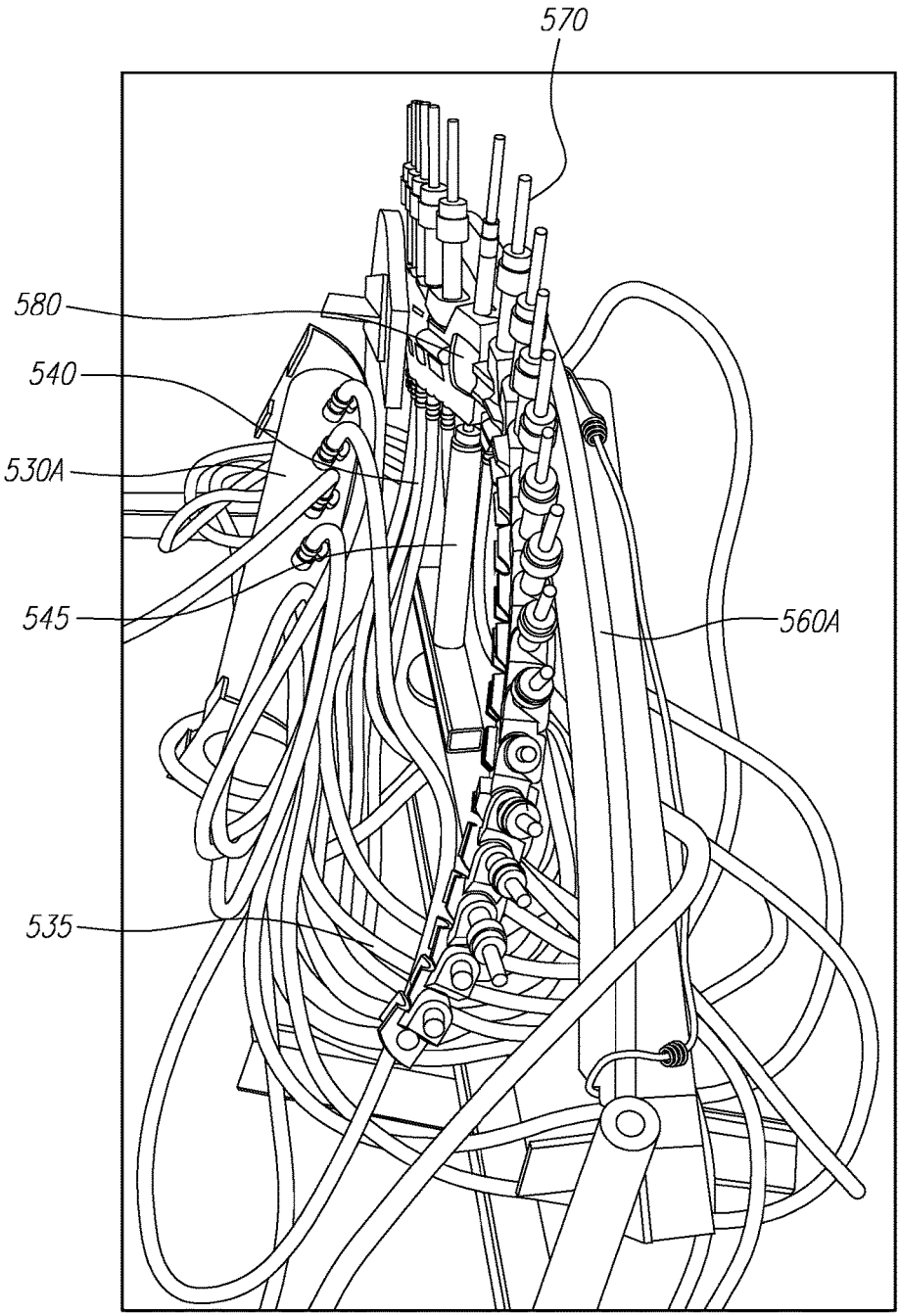
FIG. 18 is a top perspective view of the alternate water delivery device.

Long guide arms 560A and short guide arms 560B, shown in FIGS. 17 and 18, may be securely attached to guide arm supports 565A, 565B. Track 5462 may be formed in the space between arms 560A, 560B. Track 562 may serve to align water shooter and water shooter segments in a straight-line configuration when desired, e.g., when a straight-line fan water pattern is desired. These guide arm supports may be made out sturdy material to provide the support to the guide arms required to maintain a consistent track through which the water shooter segments can travel.

Figure 19:
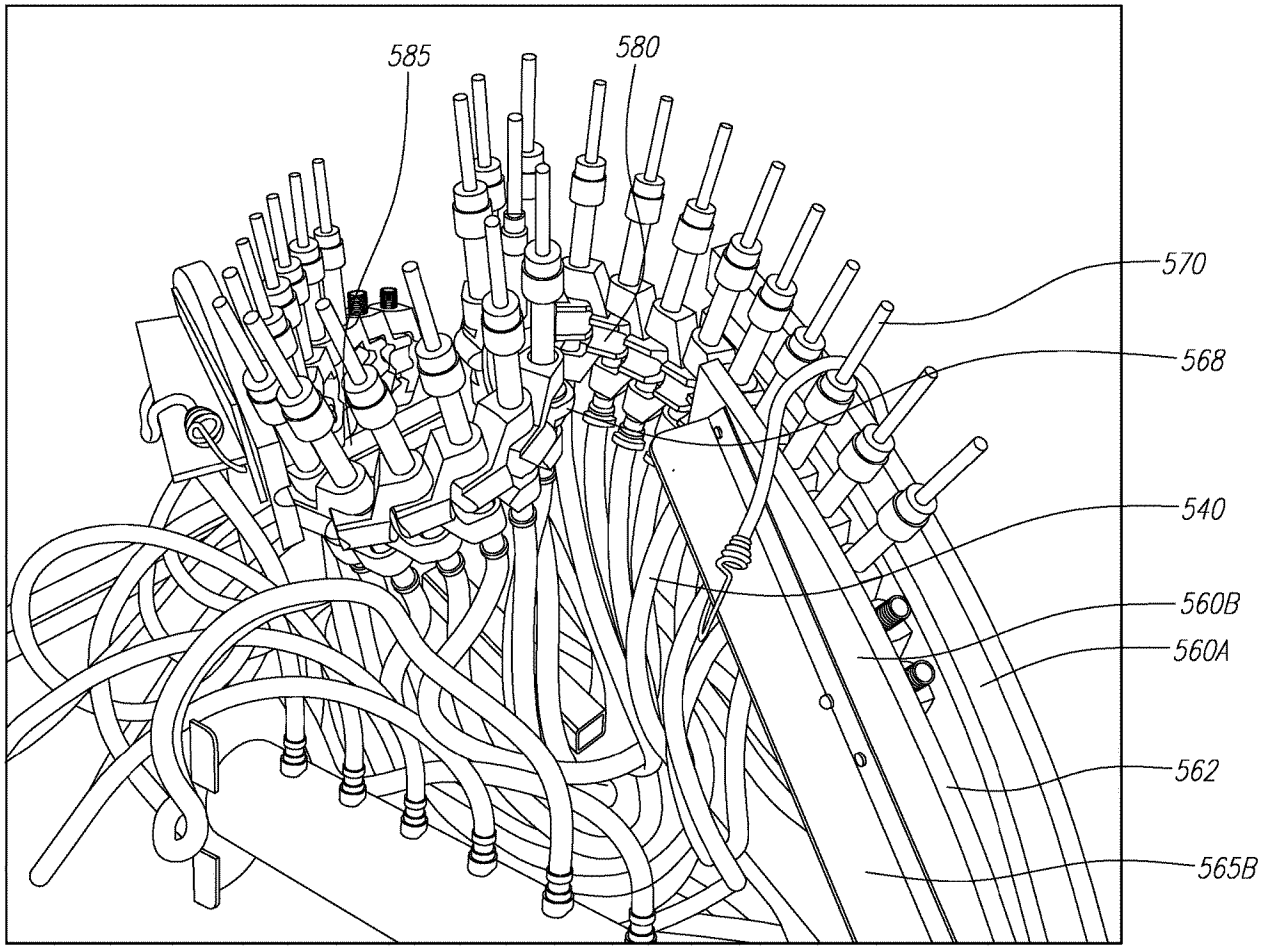
FIG. 19 is a perspective view of the alternate water delivery device in a partially closed position.

The short guide arm 560A provides a gap 568, shown in FIGS. 17 and 19, through which the string of water shooters 570 may be pulled outside of track 562 and repositioned outside the track in a spiral circular configuration. Different shapes from the straight-line water shooter configuration may result.

A line of water shooters 570 may extend outward from a central tube 545 (which itself may also be a water shooter). This line of water shooters may be supported by a combination of vertical support posts 520A and 520B, which may support guide arm supports 565A and 565B and guide arms 560A and 560B as shown on FIG. 17. The vertical supports tubes may be attached to each end of the longitudinal central spine tube 510A.

As shown in FIG. 17, vertical support tubes 520A and 520B may support guide arm supports 580A and 580B, which in turn may support guide arms 560A and 560B in order to support water shooter segments 580 that may support the water shooters 570. The guide arms may align a line of water shooters in a straight-line configuration.

As shown in FIG. 17, water shooters 570 may be attached to water shooter segments 580. These water shooter segments may be shaped in such a way that they may follow a track 562 created between guide arms 560 to allow controlled movement of these water shooter segments and water shooters along guide arms 560. Water shooters 570 may be made of a metallic material that may be sturdy enough to withstand the substantial water pressures anticipated to be endured by this invention.

Guide arms 560, shown in FIG. 17, may be made of a material that is resistant to wear from the motion of the water shooter segments within the track 562 created by the parallel positioning of guide arms, yet also of low coefficient of friction so that the motion of the string of segments along the track will be smooth and not balky.

Water shooter valves 575 may be integrated into the water shooters themselves in order to provide variable options as to the water flow and/or water stream shape to be projected from the water shooters.

Flexible tubes 540 may be mounted at one of its ends to manifold 530 and at the other of its ends to water shooter/water shooter segment assembly. Water may be fed from the manifold to the water shooter to produce the desired water stream fan. The flexible tubes may be made of supple material to allow the full range of movement desired within the water delivery device.

The water shooter segments 580, shown in FIGS. 13 and 15, to which the water shooters may be attached, may be interlocked to stay connected to each other and in such a fashion that allows a lateral range of motion that will allow the length of segments to be pulled through the gap and into a curled configuration. The water shooter segments 580 may be made of a material that is resistant to wear from the motion they endure, yet also of low coefficient of friction so that the motion of the string of segments will be smooth and not balky.

Referring to FIGS. 17 and 19, guide arms 560 may be further constructed such that there is both a long guide arm 560A and a short guide arm 560B. When supported in parallel by long and short guide arm supports 565A and 565B, there is a gap 568 created near the central tube 545 that may allow the line of water shooter-bearing segments 580 to be moved in such a fashion that the line of water shooter-bearing segments spirally curl upon itself after passing through the gap.

Figure 20:
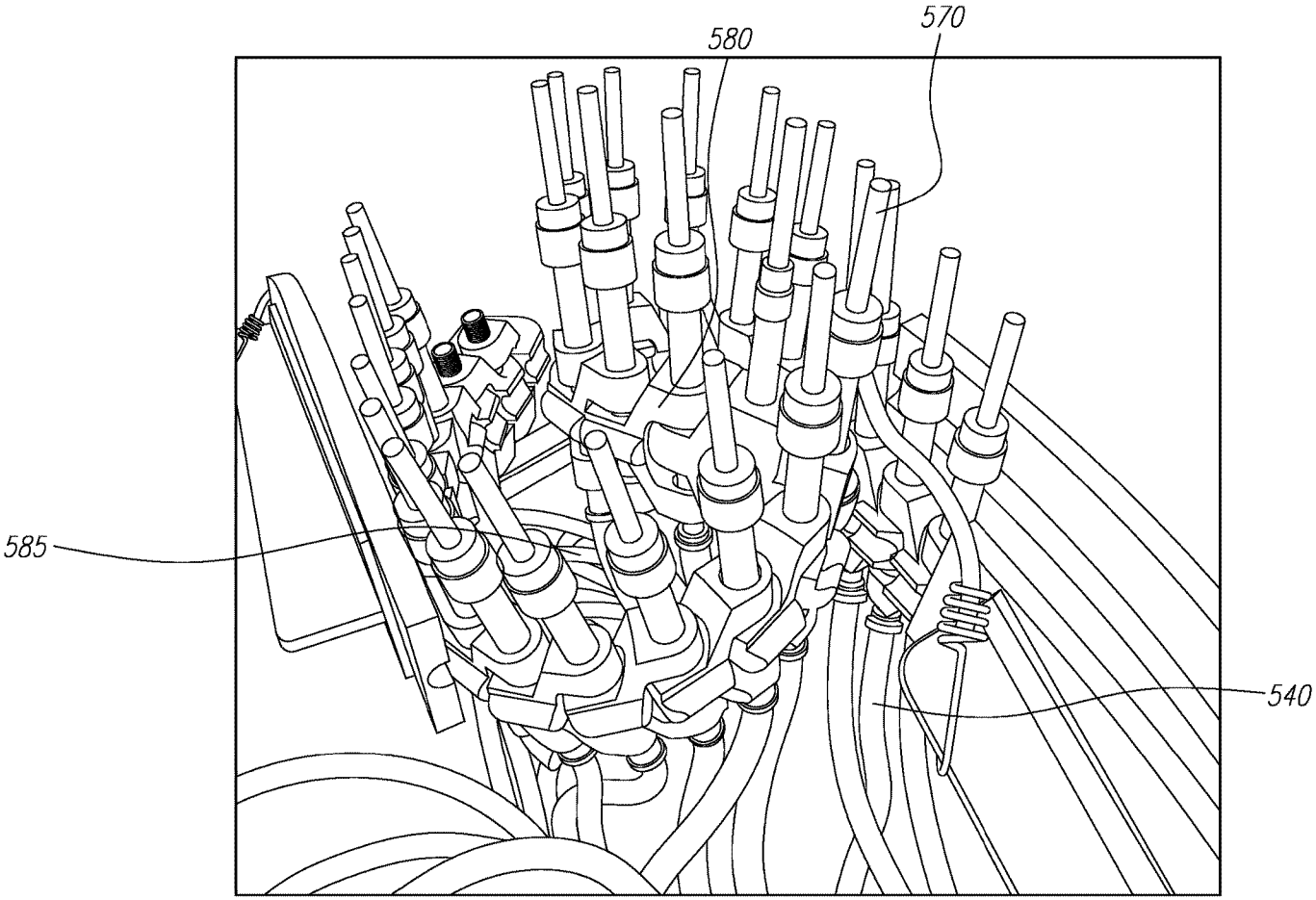
FIG. 20 is a perspective view of the alternate water delivery device in a further closed position.
Figure 21:
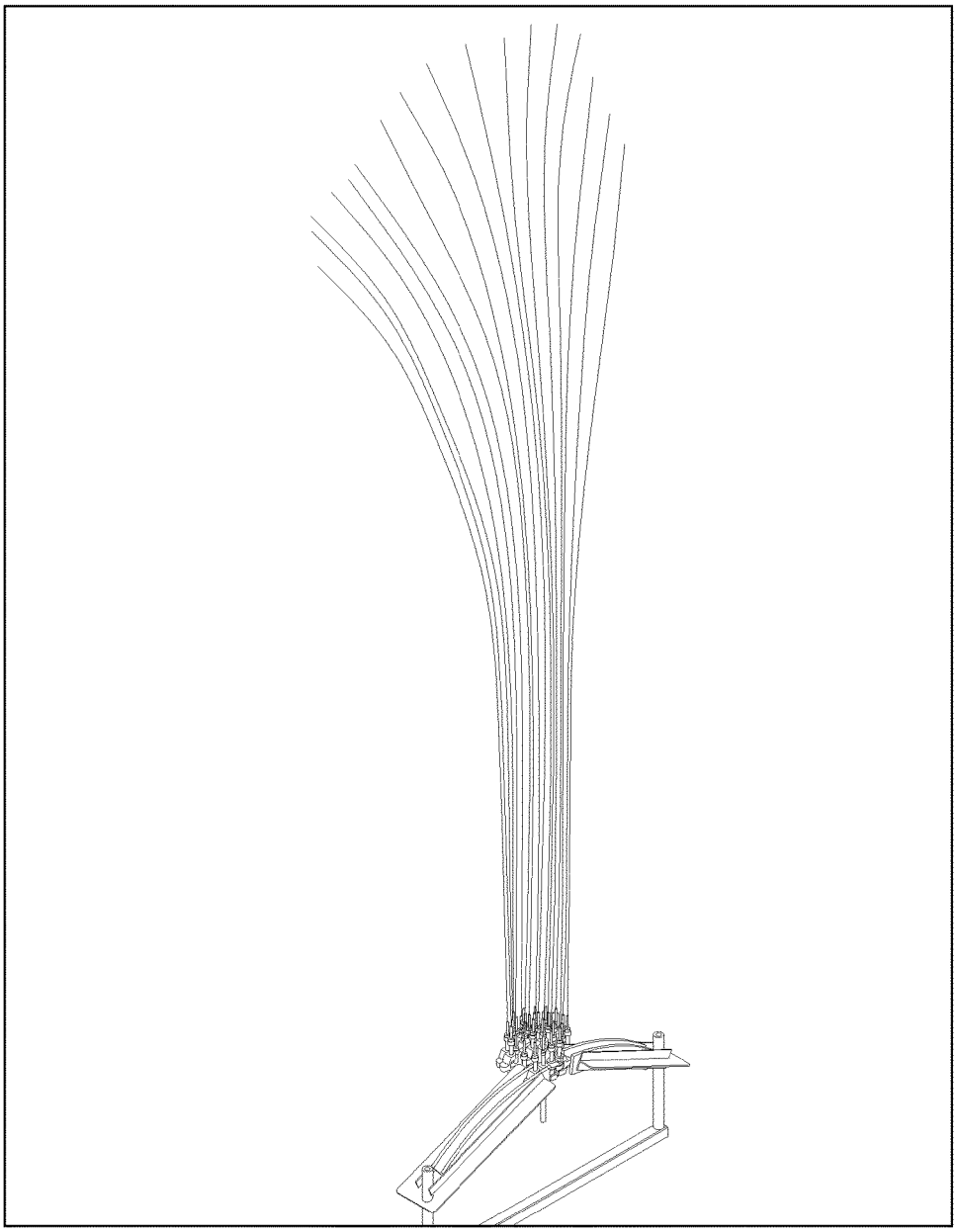
FIG. 21 shows a water stream pattern provided by the alternate water delivery device in a further closed position.

Referring to FIG. 17, motor 590 may be mounted at the base of central tube 545. Motor 590 may rotate central tube 545 in order to pull the water shooter/water shooter segment assemblies through gap 568 in a spiral circular configuration, as shown in FIGS. 19 and 20. This circular configuration may produce different water stream fan shapes. The motor's operation may also be reversed in order to push the water shooters back through the gap and to the track 526 formed by the guide arms 560.

Spring 595, as shown in FIG. 17, may be mounted alongside longitudinal central spine tube 510A at one end and at the motor 590 at the other end, which in turn is mounted to the central tube 545. Spring 595 may provide the pulling force needed to reverse the motor's spiral curling of the water shooters and move the water shooters back to an inline configuration within the track of the guide arms. The spring's pulling force may be the result of the tensile force stored in the spring as the motor pushes the water shooters through the gap to form the spiral circular configuration.

When water shooters 570 are in a line configuration, a water stream fan having the width provided by the line of water shooters can be produced. Certain water shooters may be shut off and on to decrease the width of the fan.

The line of water shooters 570 may also be twisted around the central tube 545 so that they curl around the central tube in a spiral pattern. This also narrows the width of the water stream fan and may also provide some depth to the fan.

The line of water shooters 570 may be further twisted around the central tube so that they are more fully curled around the central tube. In this configuration, the water stream fan is narrower still and may actually appear to be a cone, since looking from the top will show that the water shooters form a spiraling circle.

Figure 22:
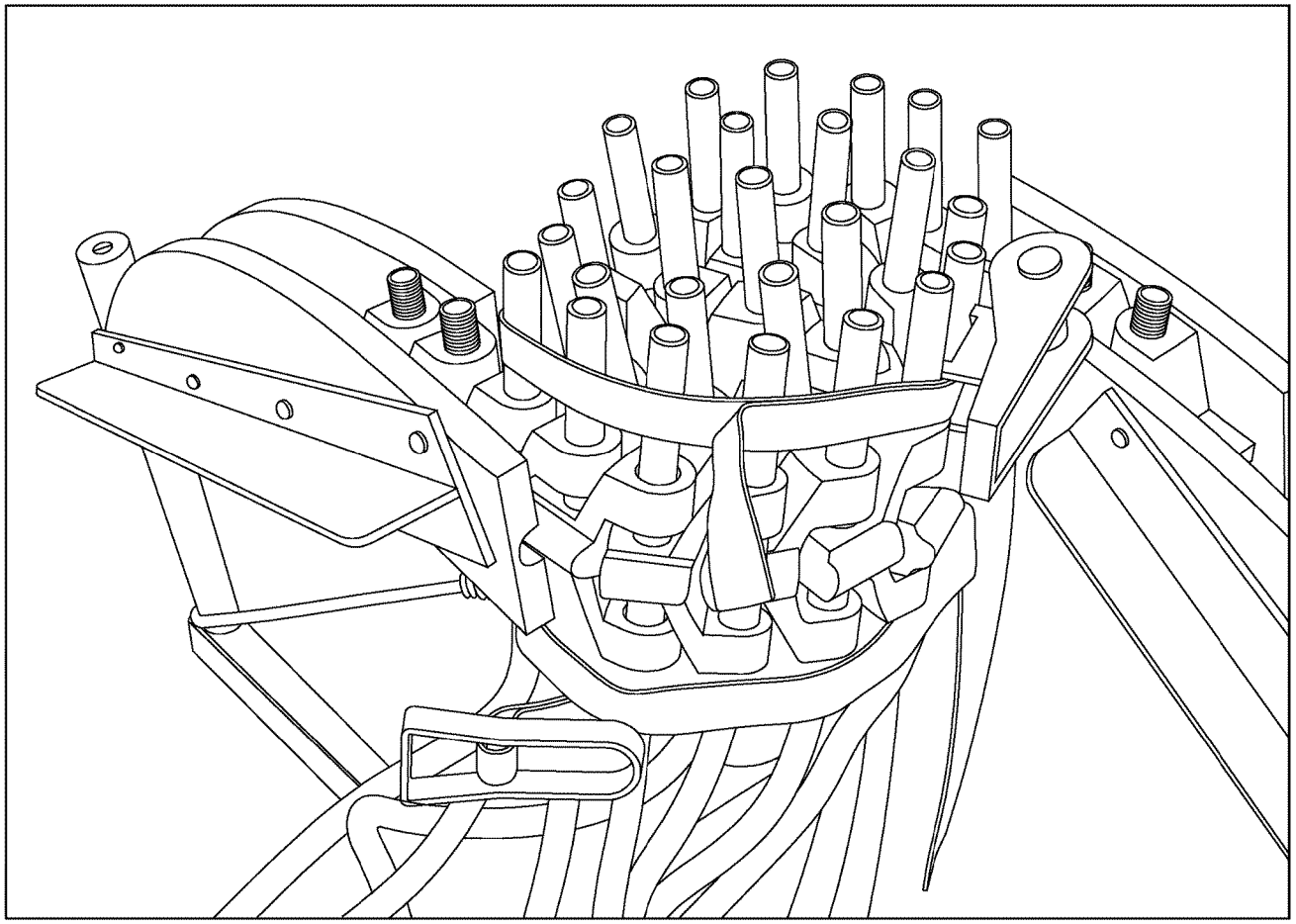
FIG. 22 is a perspective view of the alternate water delivery device in further closed position.
Figure 23:
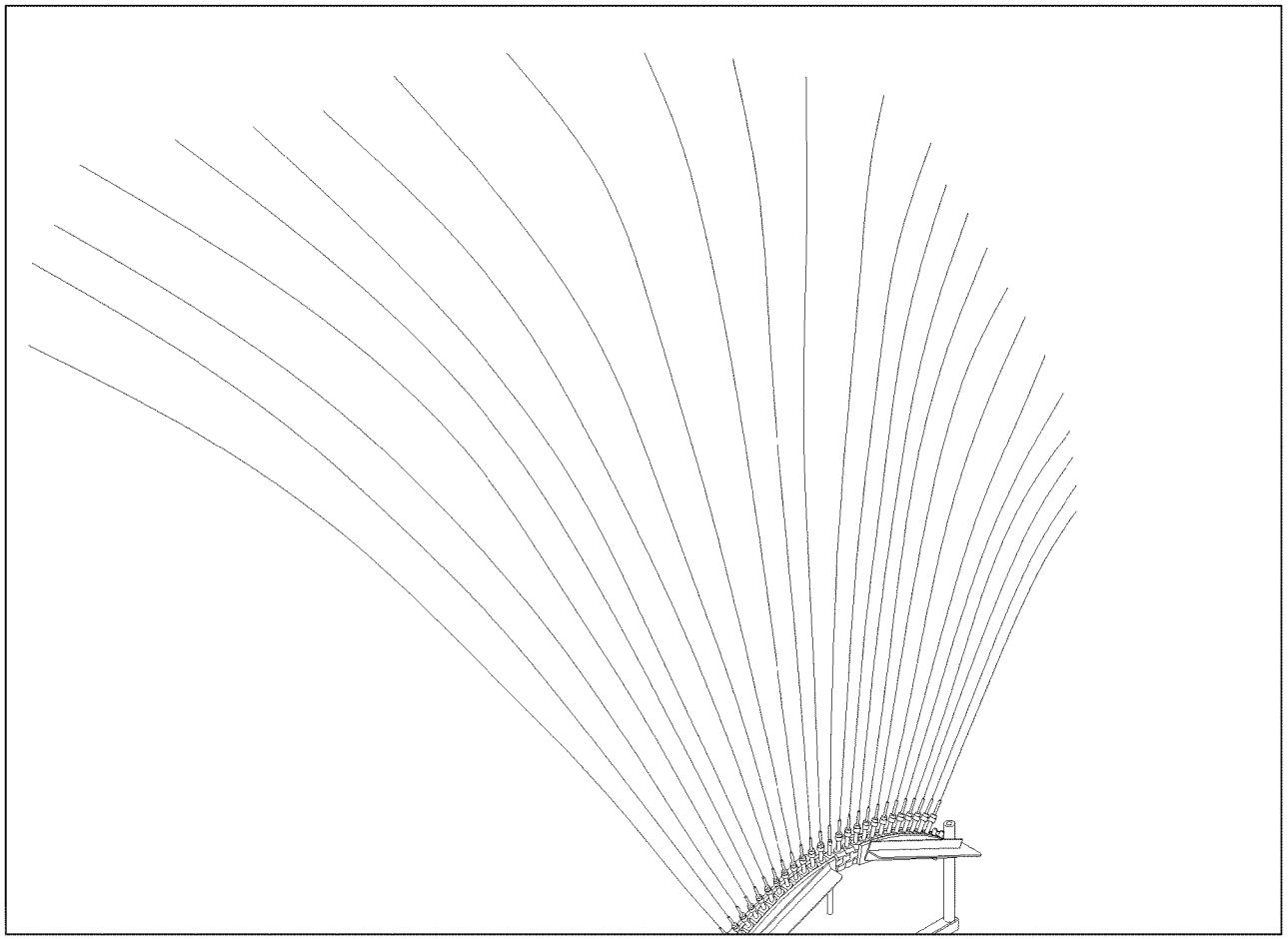
FIG. 23 shows a fan water stream pattern.
Figure 24:
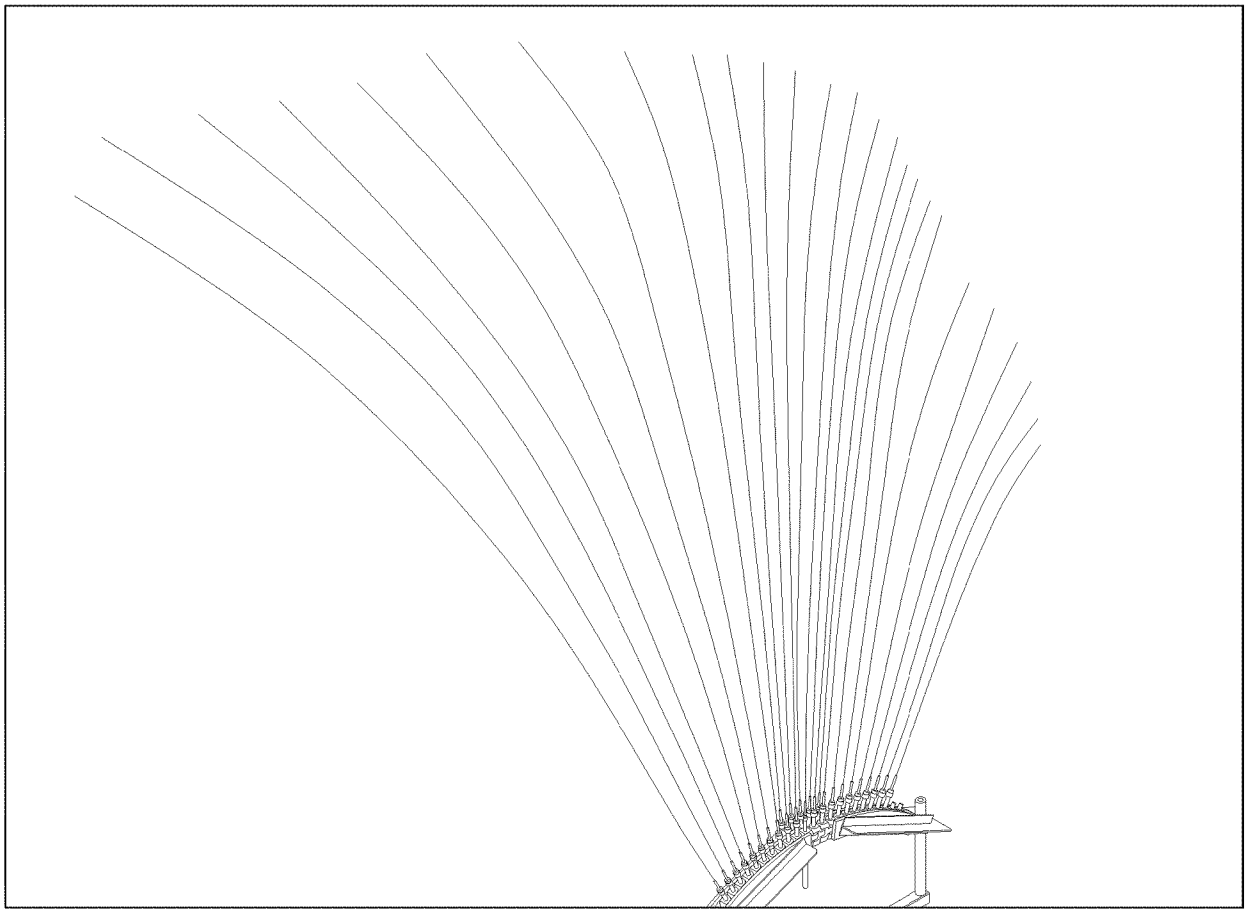
FIG. 24 shows a fan water stream pattern.
Figure 25:
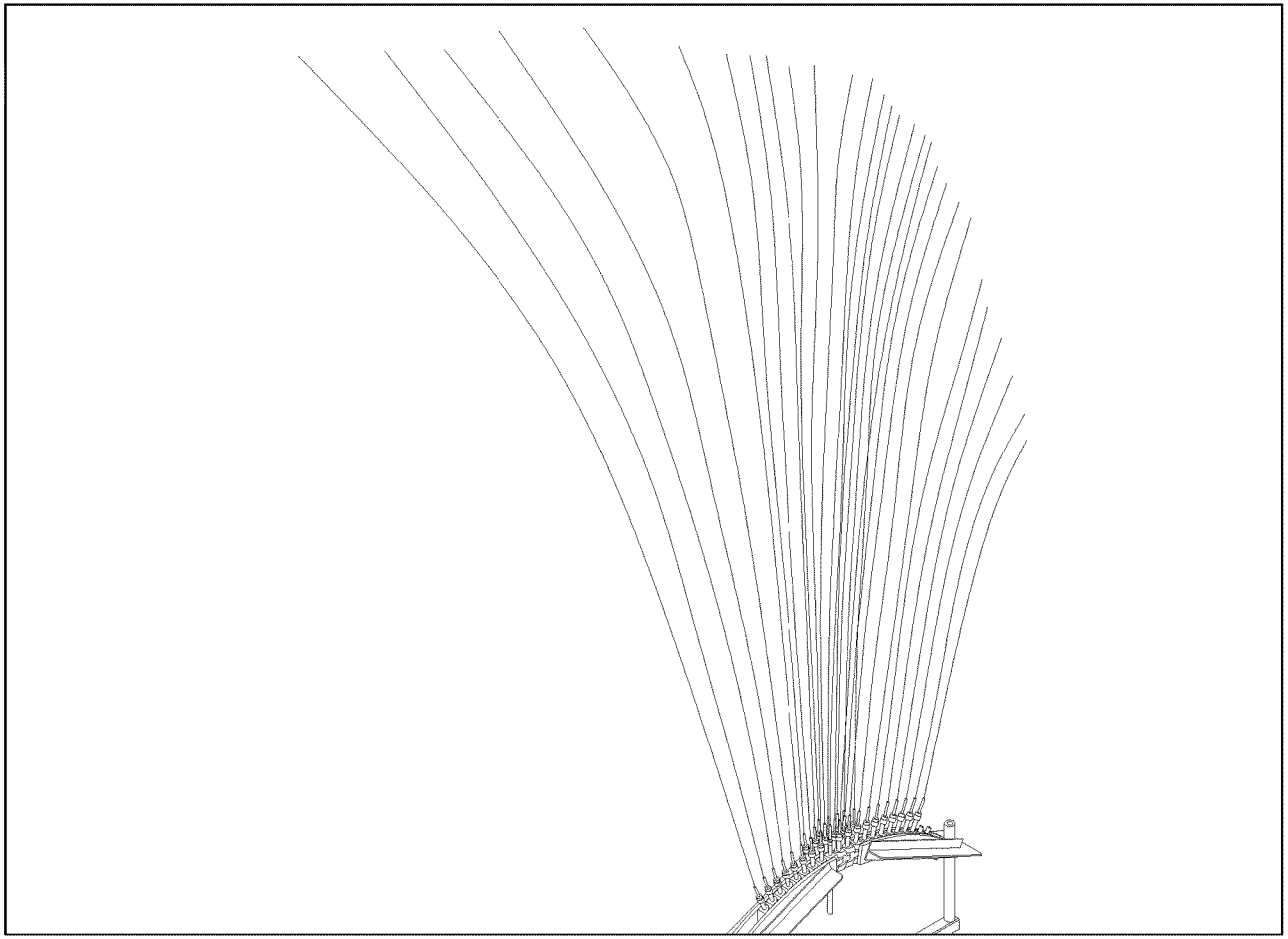
FIG. 25 shows a fan water stream pattern.
Figure 26:
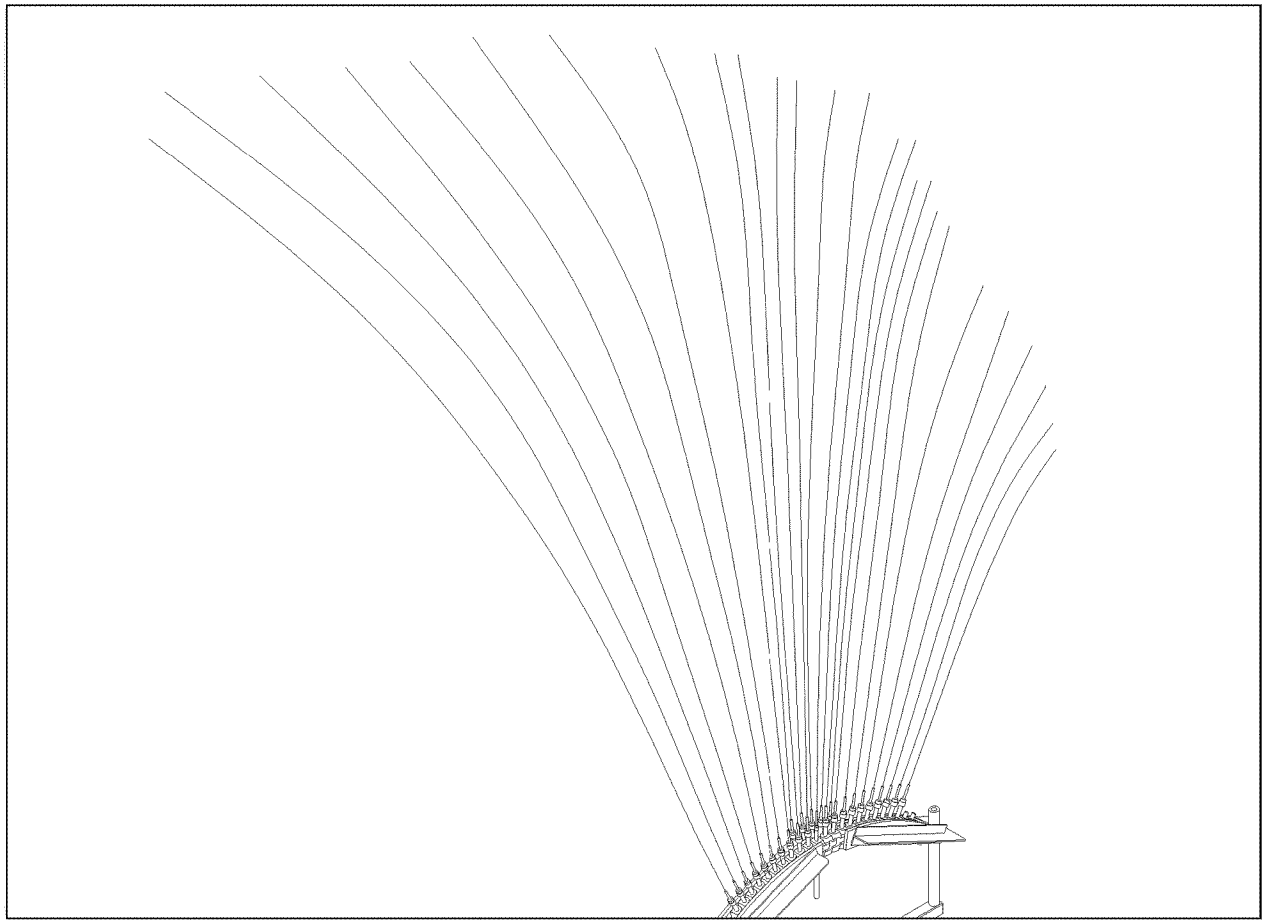
FIG. 26 shows a fan water stream pattern.

FIGS. 21-26 show possible water patterns that may be produced by device 500. As shown, this may include a relatively straight column of water as in FIG. 21, which pattern may be produced when the water shooters 570 are "spiraled up" around central shooter 545 as shown in FIG. 22. Varying fan width water patterns may also be produced as shown in FIGS. 23-26.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A water delivery device that emits a stream of water that may be varied in appearance, comprising:

opposing flanges that each include an inner surface and an end wall, that are assembled and remain assembled together through an overlapping engagement of the inner surfaces, that when assembled form a nozzle having an orifice defined by the inner surfaces and the end walls through which the stream of water is emitted, and that are rotatable relative to each other to move the end walls toward each other or away from each other to thereby vary the size of the orifice;

to vary the appearance of the stream of water; and wherein the opposing flanges each include a mounting flange having a hole that accommodates a pipe which provides water.

2. The water delivery device of claim 1, wherein the opposing flanges may rotate relative to each other about the axis of the pipe.

3. The water delivery device of claim 1, wherein each of the opposing flanges includes an arm and a slot, and the overlapping engagement is formed by the arm of each flange fitting into the slot of the opposing flange.

4. The water delivery device of claim 3, wherein the opposing flanges are substantially identical, and wherein the flanges are oriented in a facing arrangement with one flange flipped 180° with respect to the other flange.

5. The water delivery device of claim 3, wherein the opposing flanges may rotate relative to each other by the arm of each flange sliding in the slot of the opposing flange.

6. The water delivery device of claim 1, wherein the opposing flanges are a pair of substantially identical flanges that are oriented in a facing arrangement with one flange flipped 180° with respect to the other flange.

7. The water delivery device of claim 1, wherein the flanges may be rotated in opposite directions relative to each other to thereby vary the size of the orifice.

8. The water delivery device of claim 1, wherein the flanges are oriented such that the inner surfaces face each other and the end walls face each other, the inner surfaces and end walls thereby defining a generally rectangular shaped orifice.

9. A water delivery device that emits a stream of water that may be varied in appearance, comprising:

a pair of opposing flanges that each are mounted to a water source, that each include a water inlet to receive water from the water source, that each include an arm and a slot, that are assembled to form a nozzle having an orifice through which the stream of water is emitted and wherein the opposing flanges are assembled by the arm of each flange fitting into the slot of the opposing flange, and that are rotatable relative to each other, by the arm of each flange sliding within the slot of the opposing flange;

wherein rotation of the flanges relative to each other varies the size of the orifice to vary the appearance of the stream of water.

10. A water delivery device that emits a stream of water that may be varied in appearance, comprising:

opposing flanges that each are mounted to a water source, that each include a water inlet to receive water from the water source, that each include an inner surface and an end wall, that are assembled and remain assembled together through an overlapping engagement of the inner surfaces, that when assembled form a nozzle having an orifice defined by the inner surfaces and the end walls through which the stream of water is emitted, and that are rotatable relative to each other to move the end walls toward each other or away from each other to thereby vary the size of the orifice to vary the appearance of the stream of water.

11. The water delivery device of claim 10, wherein the water source is a pipe.

12. The water delivery device of claim 11 wherein the opposing flanges may rotate about the axis of the pipe.

13. The water delivery device of claim 10, wherein the opposing flanges are a pair of substantially identical flanges that are oriented in a facing arrangement with one flange flipped 180° with respect to the other flange.

14. The water delivery device of claim 10, wherein the flanges are oriented such that the inner surfaces face each other and the end walls face each other, the inner surfaces and end walls thereby defining a generally rectangular shaped orifice.

15. The water delivery device of claim 10, wherein the flanges may be rotated in opposite directions relative to each other to thereby vary the size of the orifice.

* * * * *